US006733178B2

(12) United States Patent
Bois

(10) Patent No.: US 6,733,178 B2
(45) **Date of Patent: *May 11, 2004**

(54) BAG HAVING CURSOR-ACTUATED COMPLEMENTARY CLOSURE STRIPS

(75) Inventor: Henri Bois, Neuilly sur Seine (FR)

(73) Assignee: Flexico-France, Henonville (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/949,082

(22) Filed: Sep. 10, 2001

(65) Prior Publication Data

US 2002/0034343 A1 Mar. 21, 2002

Related U.S. Application Data

(62) Division of application No. 09/462,101, filed as application No. PCT/FR99/01455 on Jun. 17, 1999.

(30) Foreign Application Priority Data

| | | |
|---|---|---|
| Jun. 17, 1998 | (FR) | 98 07658 |
| Jun. 24, 1998 | (FR) | 98 08019 |
| Jul. 3, 1998 | (FR) | 98 08525 |
| Nov. 2, 1998 | (FR) | 98 13732 |

(51) Int. Cl.[7] ..... B65D 33/16

(52) U.S. Cl. ..... 383/59; 383/5; 383/63; 383/64; 493/213; 493/214; 24/400; 24/399; 24/489

(58) Field of Search ..... 24/399, 400, 489, 24/30.5 R, 427, 587, 30.5 D, 576; 383/5, 61, 63, 64, 59; 493/213, 214

(56) References Cited

U.S. PATENT DOCUMENTS

| | | | | |
|---|---|---|---|---|
| 3,338,284 A | * | 8/1967 | Ausnit | 24/585.12 |
| 3,425,469 A | * | 2/1969 | Ausnit | 24/585.12 |
| 3,633,642 A | * | 1/1972 | Siegel | 383/64 |
| 4,235,653 A | * | 11/1980 | Ausnit | |
| 4,736,451 A | | 4/1988 | Ausnit | |
| 4,736,496 A | * | 4/1988 | Fisher et al. | 383/65 |
| 4,791,710 A | * | 12/1988 | Nocek et al. | |
| 4,925,316 A | * | 5/1990 | Van Erden et al. | |
| 5,007,142 A | * | 4/1991 | Herrington | 24/399 |
| 5,017,021 A | | 5/1991 | Simonsen et al. | |
| 5,020,194 A | * | 6/1991 | Herrington et al. | 24/400 |
| 5,067,208 A | * | 11/1991 | Herrington et al. | 24/399 |
| 5,442,837 A | | 8/1995 | Morgan | |
| 5,592,802 A | | 1/1997 | Malin et al. | |
| 5,638,586 A | * | 6/1997 | Malin et al. | |
| 5,956,815 A | * | 9/1999 | O'Connor et al. | |

(List continued on next page.)

FOREIGN PATENT DOCUMENTS

| | | | |
|---|---|---|---|
| DE | 1 950 724 | 4/1971 | |
| EP | 0 051 010 | 5/1982 | |
| EP | 0 102 301 | 3/1984 | |
| EP | 0 479 661 | 4/1992 | |
| FR | 2 761 956 | 10/1998 | |
| JP | 4-294747 | * 10/1992 | 383/59 |
| WO | WO 88/04634 | * 6/1988 | 493/214 |
| WO | WO98/24704 | 6/1998 | |
| WO | WO98/45180 | 10/1998 | |

*Primary Examiner*—Robin Hylton
(74) *Attorney, Agent, or Firm*—Jacobson Holman PLLC

(57) ABSTRACT

A bag including two generally parallel sheets forming the main walls of the bag, complementary closure strips fixed to respective ones of the sheets, and a cursor for actuating the strips for closing and opening purposes. Parallel to the closure strips between the sheets, and level with the mouth of the bag, additional sealing structure in relief disposed on the insides of the closure strips, designed to provide sealing by forming a barrier between the sheets in the closed position of the bag, the additional sealing structure in relief being placed facing the flanks of the cursor to be urged towards their sealing position by the cursor when the cursor is moved towards the sealing position.

15 Claims, 15 Drawing Sheets

U.S. PATENT DOCUMENTS 5,964,368 A * 10/1999 Schramm ..... 220/320
6,032,437 A * 3/2000 Bois ..... 493/213
6,047,450 A * 4/2000 Machacek et al. ..... 24/399
6,088,887 A * 7/2000 Bois ..... 24/399
6,220,754 B1 * 4/2001 Stiglic et al. ..... 383/64
6,290,393 B1 * 9/2001 Tomic ..... 24/399
6,305,844 B1 * 10/2001 Bois ..... 24/399

* cited by examiner

BAG HAVING CURSOR-ACTUATED COMPLEMENTARY CLOSURE STRIPS

This is a divisional of application Ser. No. 09/462,101 filed Jan. 13, 2000 which in turn is a continuing application of the national phase under 35 USC §371 of PCT International Application No. PCT/FR99/01455 which has an International Filing Date of Jun. 17, 1999, which designated the United States of America and was published in French and claims priority from 98/07658 filed Jun. 17, 1998, 98/08019 filed Jun. 24, 1998, 98/08525 filed Jul. 3,1998 and 98/13732 filed Nov. 2, 1998 all of which were filed in France which are claimed herein.

The present invention relates to the field of bags having complementary closure strips that are actuated by a cursor both for opening and for closing.

Such bags are described, for example, in documents EP-A-0 051 010, EP-A-0 102 301, and EP-A-0 479 661.

Those bags that are cursor-actuated both for opening and for closing have already given good service.

The cursors make the bags easier to open and close. The presence of a cursor is particularly appreciated by the elderly and the visually handicapped.

Nevertheless, most known bags with cursors do not give full satisfaction. In particular, most such bags are not totally leakproof when the strips are in the closed position. This lack of sealing is due to the fact that the strips remain separate ahead of the cursor.

Nevertheless, leakproofing is required in numerous applications, particularly, but not exclusively, for bags that are used for freezing foodstuffs.

Attempts have been made to remedy that drawback by proposing closure strips that present a local discontinuity in the vicinity of the end which receives the cursor when the bag is in the closed position, such that the cursor penetrates into the discontinuity and ensures that the strips are perfectly engaged in one another over their entire length when in the closed position.

Nevertheless, the means proposed in that context turn out to be very complex. Even so, they do not always ensure that the bags are perfectly sealed. In addition, they suffer from the major drawback of not retaining the cursor reliably and consequently of running the risk of the cursor being swallowed by small children, for example.

The object of the present invention is to improve the performance of known cursor-fitted bags.

The main object of the present invention is to propose bags presenting leakproofing that is better than that of previously known bags.

Another object of the present invention is to propose means that reduce the risk of the cursor being removed by mistake, specifically in order to reduce the risk of the cursor being swallowed by young children.

Another object of the present invention is to propose means enabling bags to be produced automatically and at a high rate of throughput.

In the context of the present invention, these objects are achieved by a bag comprising two generally parallel sheets forming the main walls of the bag, complementary closure strips fixed to respective ones of the sheets, and a cursor for actuating the strips for closing and opening purposes, the bag being characterized in that it further comprises, parallel to the closure strips, between said sheets, and level with the mouth of the bag, additional means in relief disposed on the insides of the closure strips, designed to provide sealing by forming a barrier between the sheets in the closed position of the bag, said additional means in relief being adapted to be urged towards their sealing position by the cursor when the cursor is moved towards its position for closing the bag.

In certain embodiments, said additional means in relief are placed facing the flanks of the cursor.

As specified in greater detail below, such additional means in relief can be formed, for example, by means of at least one bead secured to the inside surface of a sheet of the bag, or by means of two symmetrical beads secured to the respective inside surfaces of the two sheets of the bag, or indeed by means of complementary male/female elements secured to respective inside surfaces of the two sheets of the bag.

According to another advantageous characteristic of the present invention, the bag, in the vicinity of its mouth includes means situated on the side of the closure strips opposite from the side on which said additional leakproofing means are situated, and adapted to define thrust between opposing inside faces of the walls of the bag, and means are provided on the cursor to urge the walls of the bag inwards in a zone of said walls lying between the additional leakproofing means and the thrust means. This guarantees that said additional means are urged into a sealing position by the cursor. This urging is preferably performed in register with the closure strips.

The present invention also provides films fitted with such sealing means and such closure strips, and also extruded tapes carrying such means.

According to another advantageous characteristic of the present invention, the bag comprises two generally parallel sheets forming the main walls of the bag, complementary closure strips fixed to respective ones of said sheets in the vicinity of the mouth of the bag, and a cursor having two side flanges interconnected by a web, the flanges being placed on the outsides of the sheets at the mouth of the bag and co-operating with a central elongate tongue to define two converging passages for the complementary closure strips, and the bag is characterized by the fact that the tongue is interrupted so as to be set back from the longitudinal end of the cursor, at least at the wider end of the cursor corresponding to the diverging ends of the passages, and that the side flanges are provided in the vicinity of their free edges remote from the web with urging means for urging the sheets of the bag towards each other, said means occupying the entire longitudinal extent of the tongue and extending longitudinally beyond each end thereof so as to ensure that the bag is leakproof when it is in its closed position.

Other characteristics, objects, and advantages of the present invention will appear on reading the following detailed description with reference to the accompanying drawings, given by way of non-limiting example, and in which.

Figure 1:
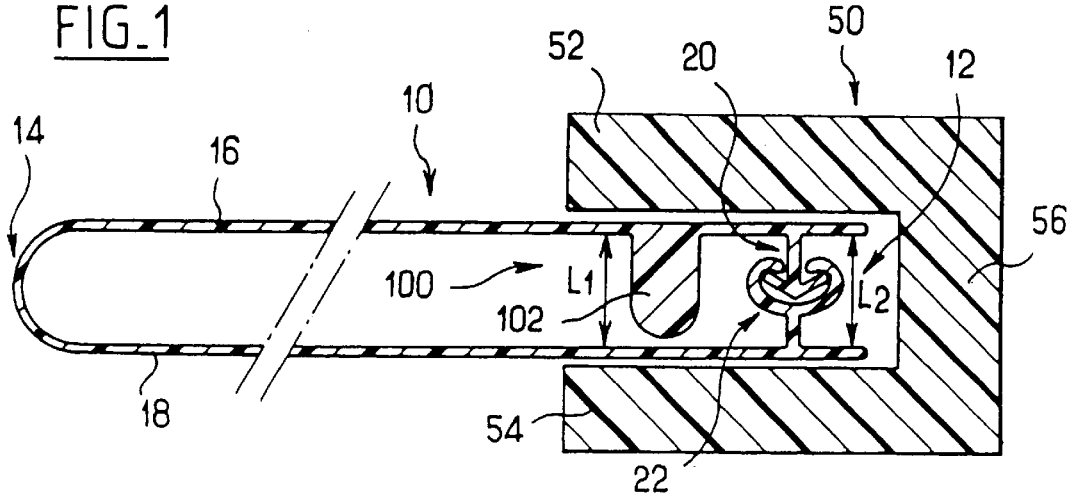
FIG. 1 is a diagrammatic section view of a bag constituting a first embodiment of the present invention.

FIG. 1 shows a bag 10 whose mouth is referenced 12 and whose bottom is referenced 14.

Figure 2:
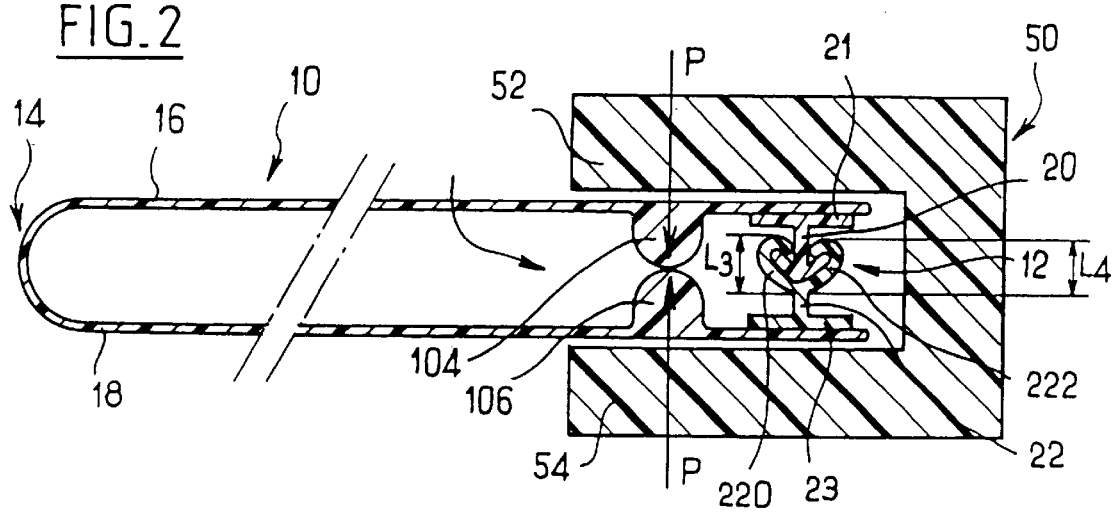
FIGS. 2 to 11 are similar section views showing a first series of variant embodiments in accordance with the present invention.
Figure 3:
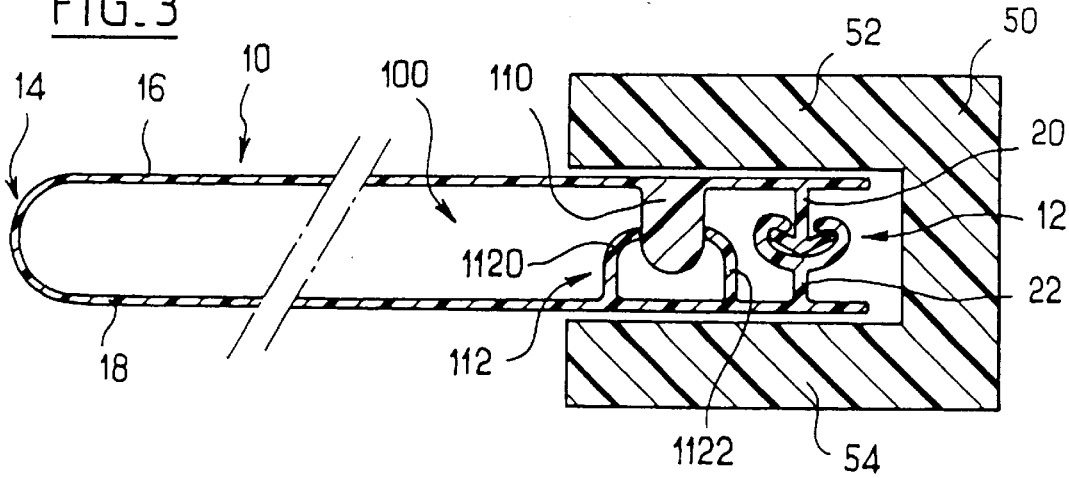
Figure 10:
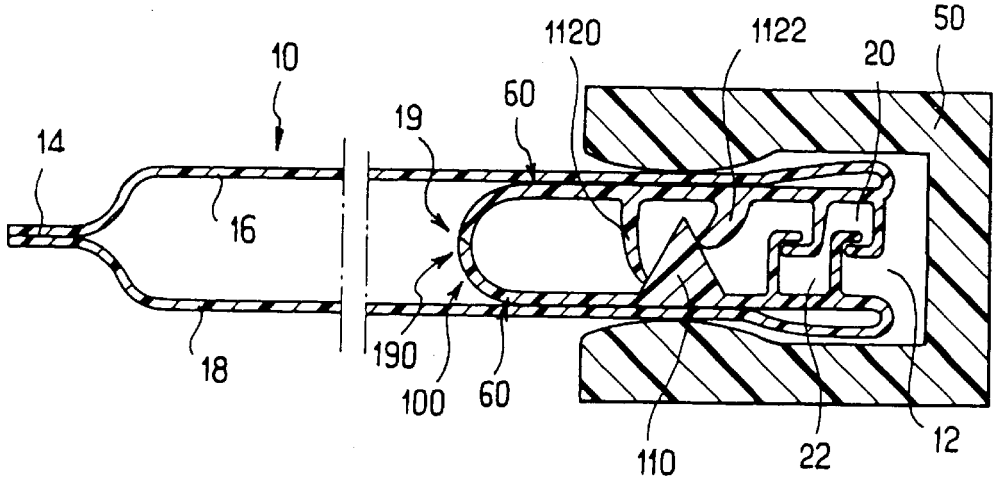
Figure 11:
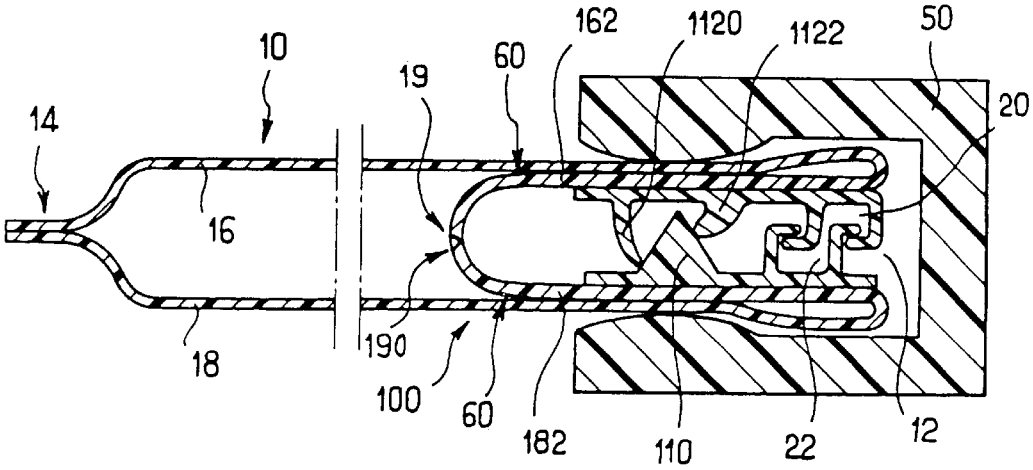

The bag 10 is made up of two main sheets 16 & 18. These are interconnected at their bottom 14 (by a fold, when the two sheets 16 & 18 are originally a single sheet as shown in FIGS. 1 to 3, or by heat sealing or adhesive when the two sheets 16 & 18 are initially separate sheets that are superposed during manufacture, as shown in FIGS. 4 to 9, or indeed by heat sealing or adhesive along the edges of a single sheet that is folded over at the mouth, e.g. as shown in FIGS. 10 and 11), and also along two side edges perpendicular to the bottom 14 and the mouth 12 (the side edges are preferably bonded together by heat sealing or adhesive).

At the mouth 12, the two sheets 16 & 18 are provided with complementary closure strips 20 & 22.

These complementary closure strips 20 & 22 can be implemented in numerous ways. The invention is not limited to the specific embodiments shown in the accompanying figures. It should also be observed that two variant embodiments of such closure strips 20 & 22 are shown in the accompanying figures, respectively in one embodiment in FIGS. 1 to 3 and 12 et seq, and another embodiment in FIGS. 4 to 11.

In particular, the invention applies to closure strips 20 & 22 that are respectively of the male and female types as is well known to the person skilled in the art and as is shown diagrammatically in FIGS. 1 to 3 and 12 et seq. However the invention is not limited to that particular disposition and can also extend, for example, to closure strips 20 & 22 of the hook type as shown in FIGS. 4 to 11.

As shown in FIGS. 1, 3 to 7, and 10, in particular, the complementary closure strips 20 & 22 can be extruded on the sheets 16 & 18 constituting the bag (more precisely on the inside surfaces of said sheets 16 & 18 in the embodiments of FIGS. 1 and 3 to 7, and on the outside surfaces of said sheets in the embodiment of FIG. 10 where the sheets 16 & 18 form an inwardly-folded bellows at the mouth of the bag so as to form a tamperproofing web for indicating whether or not the bag has already been opened).

Nevertheless, in a variant embodiment, the closure strips 20 & 22 can initially be formed on respective support webs 21 & 23 that are fitted to the sheets 16 & 18 level with the mouth 12 of the bag, as shown in FIGS. 2, 8, 9, and 11. In this case also, it will be observed that in FIGS. 2, 8, and 9, the support webs 21 & 23 are fixed to the inside surfaces of the sheets 16 & 18. In contrast, in FIG. 11 the sheets 16 & 18 form a bellows that is folded into the bag at its mouth so as to form a tamperproofing web, with the support webs 21 & 23 being fixed on the outside surfaces of the sheets 16 & 18.

The webs 21 & 23 can be bonded to the films 16 & 18 by any suitable conventional means, e.g. by heat sealing or by adhesive.

The use of closure strips that are not extruded on the films 16 & 18 but that are fitted thereto by heat sealing or adhesive is shown in the accompanying drawings only in FIGS. 2, 8, 9, and 11. Nevertheless, the use of such closure strips 20 & 22 fitted to the films 16 & 18 can apply to all of the various embodiments of the invention.

As mentioned above in the context of the present invention, the bag also has a cursor 50 adapted to actuate the strips 20 and 22 for opening and closing purposes, and also, parallel to the closure strips 20 and 22, between said sheets 16 and 18, and level with the mouth 12 of the bag, additional means in relief 100 designed to provide leakproofing by forming a barrier between the sheets 16 and 18 when the bag is in the closed position, said additional means in relief 100 being placed in register with the flanks 52 and 54 of the cursor 50 so as to be urged towards their sealing position by the cursor 50 when it is moved towards its sealing position.

The cursor 50 can be embodied in numerous conventional ways. In particular, the cursor 50 can be in accordance with the dispositions described in document EP-A-0 479 661.

That is why the cursor 50 is not described in greater detail below.

Nevertheless, it should be observed that the cursor 50 which is made of plastics material preferably has two side flanges 52 & 54 (or "flanks") interconnected via a web 56 and co-operating with an elongate central tongue (not shown in the accompanying figures at the location of the section plane shown) to define two converging passages for the interfittable complementary closure strips 20 & 22. Thus, when the direction of relative displacement between the cursor 50 and the closure strips 20 & 22 tends to move the cursor 50 so as to force the closure strips 20 and 22 into engagement, the bag is closed. When the cursor 50 is moved in the opposite direction, the bag is opened.

The films 16 & 18, the closure strips 20 & 22, and the additional leakproofing means 100 can be made of any suitable plastics material known to the person skilled in the art. Preferably, they are made of polyolefin, most advantageously of low or high density polyethylene, or even of polypropylene.

In the context of the present invention, it is preferable for the means 100 to be placed on the inside of the closure strips 20 & 22 (i.e. towards the inside of the bag relative to the closure strips 20 & 22) and they preferably extend over the entire length of the bag (i.e. they have the same length as the closure strips 20 & 22).

In the first embodiment shown in FIG. 1, said additional leakproofing means 100 are formed by a bead 102 parallel to the strip 20 and secured to one of the sheets 16. In FIG. 1, this bead 102 is extruded on the film 16. However, in a variant, as mentioned above, the bead 102 could be extruded on a support web which is in turn secured to the film 16.

Such a bead 102 is placed facing the flanks 52 & 54 of the cursor 50 and on the inside thereof. Thus, the bead 102 is urged to press against the opposite film 18 when the cursor 50 is moved to its closure position.

The shape of the strips 20 & 22, of the means 100, and of the cursor 50 are preferably such that the flanks 52 & 54 of the cursor 50 impose transverse play (i.e. perpendicularly to the sheets 16 & 18) on the means 100 that is smaller than that tolerated for the closure strips 20 & 22.

For this purpose, for example, when the inside surfaces of the flanks are parallel, as shown in the accompanying figures, the thickness $L_1$ of the means 100 is greater than the thickness $L_2$ defined by the closure strips 20 & 22 when they are mutually engaged.

This preferred relationship $L_1 > L_2$ is not limited to the embodiment shown in FIG. 1 but applies to all embodiments of the present invention, including when said leakproofing means 100 are formed by two beads or indeed by complementary male/female means, or by any other equivalent means, as described below.

This disposition makes it possible to guarantee that the means 100 provide a leakproof barrier between the two films 16 & 18.

In the embodiment shown in FIG. 2, the leakproofing means 100 are formed by two beads 104 & 106 respectively secured to each of the two films 16 & 18 and placed facing each other so as to have their tops coming into contact to form a leakproof barrier, when they have been urged together by the flanks 52 & 54 of the cursor 50. In FIG. 2, the two beads 104 & 106 are symmetrical. However, in a variant, it is possible to provide beads 104 & 106 that are asymmetrical.

In the embodiment shown in FIG. 3, the sealing means 100 are constituted by complementary male/female elements 110 & 112 that are secured to the respective inside surfaces of the two sheets 16 & 18 of the bag. Still more precisely, in FIG. 3, the female element 112 has two lips 1120 & 1122 adapted to rest against respective flanks of the male element 110. In FIG. 3, the two lips 1120 & 1122 are symmetrical. However, in a variant, it is possible to have two lips 1120 & 1122 that are asymmetrical. The male element 110 is generally rounded in shape.

Figure 4:
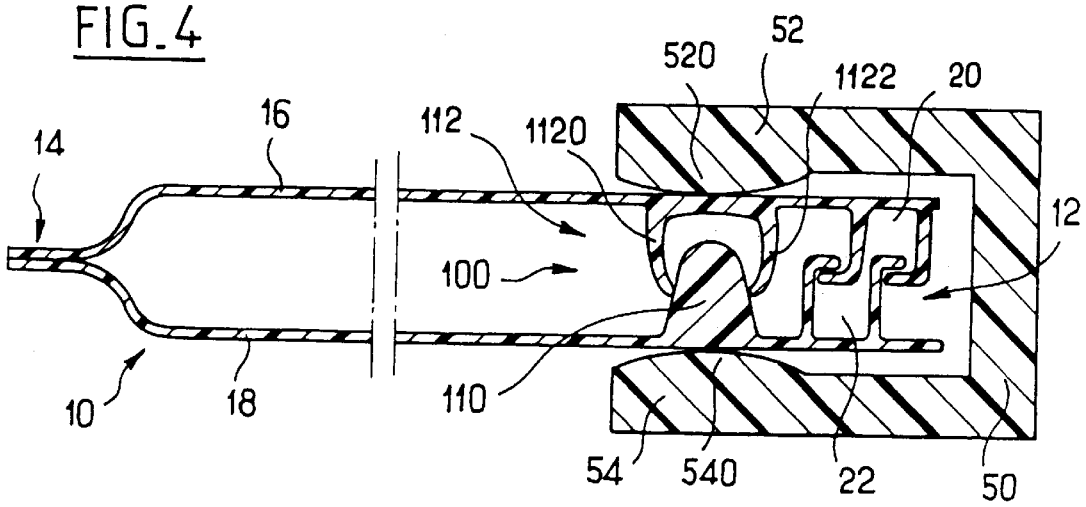

The leakproofing means 100 shown in FIG. 4 are identical to those of FIG. 3. However, in FIG. 4 it will be observed that the cursor 50 has projections 520 & 540 on the inside surfaces of its flanks 52 & 54, which projections are in register with the means 100 so as to ensure that these means are urged into their leakproofing position when the bag is closed. Such projections 520 & 540 can be in a wide variety of shapes. In a variant, such projections can be provided on the outside surfaces of the walls 16 & 18 where they face the cursor, or indeed such projections can be formed on the walls of the bag and other projections facing them can be formed on the cursor 50.

Figure 5:
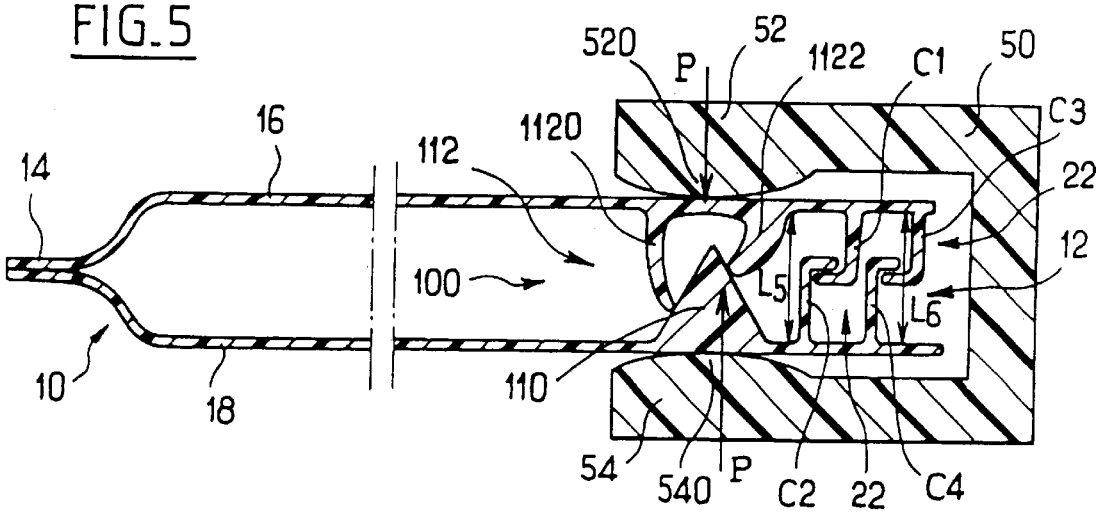

FIG. 5 shows another variant embodiment in which the male element 110 is substantially triangular in section. This structure guarantees that contact between the flanks of the male element 110 and the lips 1120 & 1122 is reinforced when the male and female elements 110 & 112 are urged together by the cursor 50.

In FIG. 5, it will also be observed that the two lips 1120 & 1122 of the female element 112 are asymmetrical. The lip 1120 situated on the inside of the bag relative to the male element 110 is preferably longer and more flexible than the other lip 1122 that is situated towards the outside of the bag. Thus, the pressure inside the bag, or indeed the contents thereof acting directly, e.g. a liquid contents, presses the first lip 1120 elastically against the male element 110. In contrast, the second lip 1122 withstands such a force and therefore does not move away from the male element 110.

As shown in FIGS. 1 to 6 and 10, the means 100 can be extruded onto the sheets 16 & 18 that constitute the bag (more precisely onto the inside surfaces of the sheets 16 & 18 in the embodiments of FIGS. 1 to 6, and on the outside surfaces of the sheets in the embodiment of FIG. 10 where the sheets 16 & 18 form an inwardly-folded bellows at the mouth of the bag so as to form a tamperproofing web).

Nevertheless, in a variant embodiment, the means 100 can initially be formed on respective support webs 121 & 123 which are applied to the sheets 16 & 18 in the vicinity of the mouth 12 of the bag, as shown in FIGS. 7 to 9 and 11. Here again it should be observed that in FIGS. 7 to 9 the support webs 121 & 123 are fixed to the inside surfaces of the sheets 16 & 18, whereas in FIG. 11 the sheets 16 & 18 form a bellows that is folded into the bag at its mouth so as to form a tamperproofing web, with the support webs 121 & 123 being fixed on the outside surfaces of the sheets 16 & 18.

Figure 8:
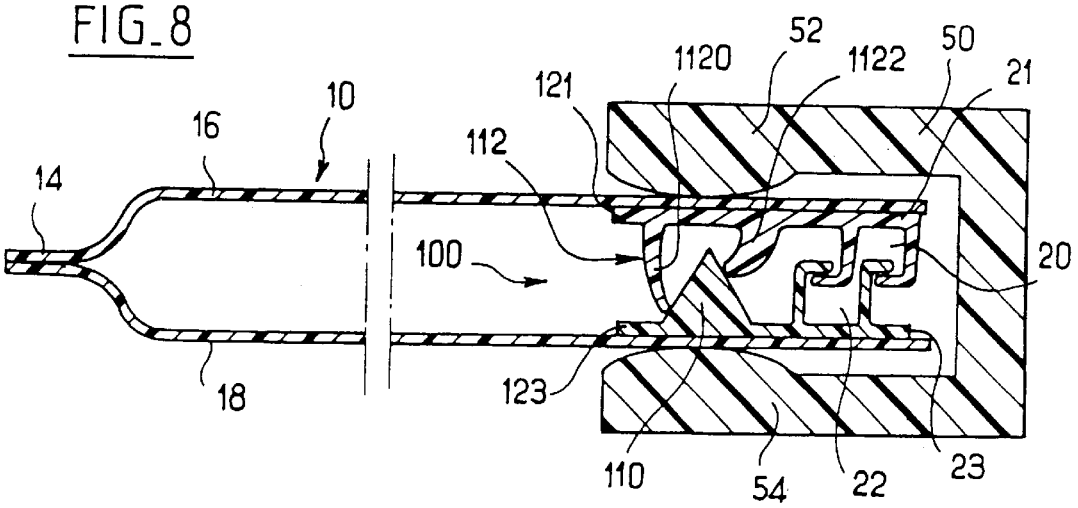
Figure 9:
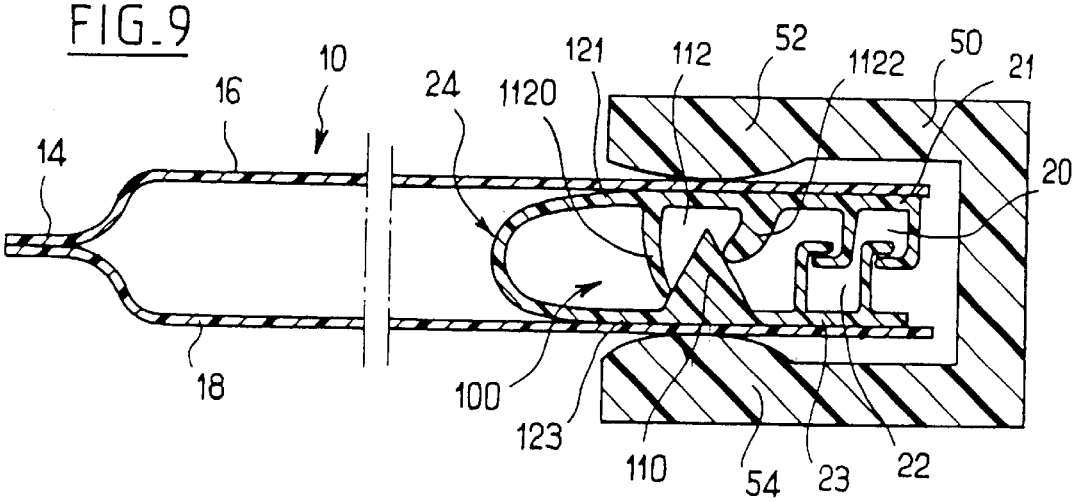

It would also be observed, as shown in FIGS. 8, 9 and 11, the support webs 121 & 123 can coincide respectively with the support webs 21 & 23 of the closure strips 20 & 22.

The bonding between the webs 121 & 123 and the films 16 & 18 can be provided by any suitable conventional means, e.g. heat sealing or adhesive.

The use of means 100 that are not extruded onto the films 16 & 18, but that are fitted thereto by heat sealing or adhesive is shown in the accompanying drawings only in FIGS. 7 to 9 and 11. However, the use of such means 100 fitted to the films 16 & 18 could apply to all of the variant embodiments of the invention.

Figure 6:
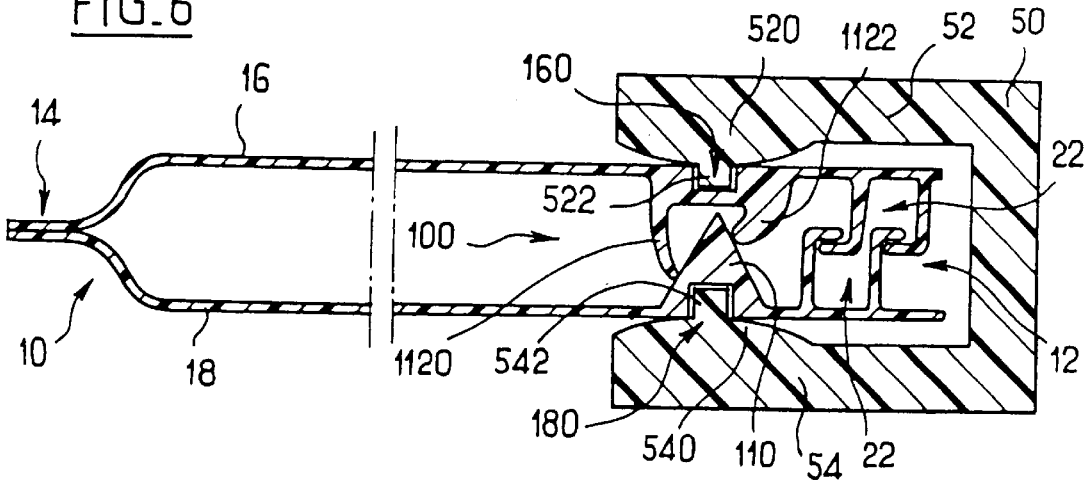

Accompanying FIG. 6 shows a variant embodiment in which grooves 160 & 180 are provided that are open in the outside surfaces of the bag, respectively in register with the means 100, and specifically respectively in register with the female element 112 and with the male element 110, and also provides ribs 522 & 542 projecting from the inside surfaces of the flanks 52 & 54 of the cursor 50, which ribs 522 & 542 are adapted to penetrate into said grooves 160 & 180, respectively.

The operation defined in this way between the grooves 160 & 180 and the ribs 522 & 542 can serve to improve the urging applied by the cursor 50 the means 100. This co-operation makes it possible to ensure that the urging from the cursor 50 is applied in a precise zone. It also makes it possible to retain the cursor 50 quite safely on the bag. This co-operation prevents any unexpected removal of the cursor 50.

The use of ribs 522 & 542 with complementary grooves 160 & 180 is shown in the accompanying drawings only in FIG. 6. Nevertheless, the use of such ribs 522 & 542 and complementary grooves 160 & 180 can be applied to all of the variant embodiments of the invention.

Figure 7:
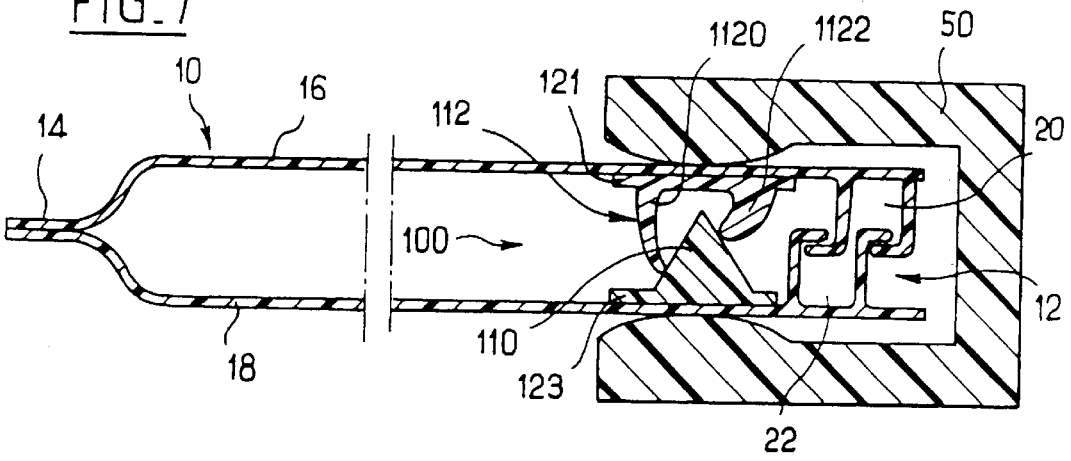

The embodiment of FIG. 7 is described above. It differs essentially from the embodiments shown in the earlier figures by the fact that the means 100 are carried by respective support webs 121 & 123 fitted to the sheets 16 & 18, as mentioned above.

The embodiment of FIG. 8 is described above. It differs essentially from the embodiments shown in the previous figures by the fact that the means 100 are carried by respective support webs 121 & 123 that also act as support webs 21 & 23 for the strips 21 and 22 and that are fitted to the sheets 16 & 18, as mentioned above.

The same applies to the embodiment shown in FIG. 9. However in FIG. 9, the support webs 121 & 21 and 123 & 23 are interconnected by a loop 24. This loop is located on the inside of the means 100 and its concave side faces towards the outside of the bag.

Thus, these support webs 121, 21, 123, 23, and 24 form a tamperproofing web for showing whether or not the mouth 12 has been opened. In order to gain access to the inside of the bag it is necessary to break the web 24. This tamperproofing web 24 constitutes a bellows folded towards the inside of the bag at its mouth 12 and it extends in continuity from the support webs 121 & 21 and 123 & 23.

FIGS. 10 and 11 show variant embodiments in which such a tamperproofing web, referenced 19, is formed by a fold in the film constituting the main sheets 16 & 18 of the bag. In FIG. 10, the strips 20 & 22 and the means 100 are integrally molded on the film. In contrast, in FIG. 11, the strips 20 & 22 and the means 100 are carried by support webs 121 & 21 and 123 & 23 that are fitted to the film.

Such a bellows 19 directed towards the inside of the bag can be shaped by any suitable known means, e.g. by means of a blade urging the bellows 19 towards the inside between the sheets 16 & 18, as is well known to the person skilled in the art.

The person skilled in the art will readily understand that it is appropriate in entirely conventional manner to break the tamperproofing web 24 or 19 in order to gain access to the substance contained inside the bag 10.

Thus, the state of the web 24 or 19 serves to indicate whether or not the bag 10 has already been used.

In order to make it easier to open the web 24 or 19, it can be provided in conventional manner with a line of weakness or of scoring, e.g. halfway across its width, as shown diagrammatically under reference 190 in FIGS. 10 and 11.

The bags obtained in application of the present invention provide numerous advantages over known prior bags.

In particular, they make it possible to have a high rate of productivity and to provide bags that are indeed leakproof.

Furthermore, the co-operation defined between the grooves 160 & 180 and the ribs 522 & 542 of the cursors 50 makes it possible to avoid any unexpected removal of the cursors 50 under the effect of pressure inside the bags or under the effect of a user pulling too hard.

Where appropriate, in the embodiments shown in FIGS. 10 and 11 where a tamperproofing web 19 is provided that is formed by a fold of the films from which the bags are made, a line of heat sealing can be provided between the inside surfaces of the main sheets 16 & 18 constituting the bag and segments 162 & 182 forming the bellows which corresponds to the tamperproofing web 19, as shown diagrammatically under reference 60 in FIGS. 10 and 11.

Naturally, the present invention is not limited to the particular embodiments described above, but extends to any variant coming within the spirit of the invention.

Bags of the present invention can be made on any suitable known type of machine, and in particular on form, fill, and seal (FFS) type machines, i.e. machines that are designed to perform automatically the operations of forming, filling, and sealing the bags.

The present invention also applies equally well to implementations in which the closure strips are placed longitudinally relative to the travel direction of the film and to implementations in which the closure strips are disposed transversely.

In addition, the present invention applies equally well to implementations in which the closure strips are prefitted with a cursor on being conveyed to the bag-forming machine, and to implementations in which the cursor is fitted to the strips subsequently.

It will also be observed that the present invention is not limited to the grooves 160 & 180 and the ribs 522 & 542 having the shapes shown in accompanying FIG. 6. These grooves 160 & 180 and ribs 522 & 542 can be implemented in a wide variety of right sections. Thus, for example, it is possible to envisage giving the grooves 160 & 180 a right section in which the sides converge, e.g. as a dovetail or in the form of a rail (e.g. a T-shaped rail). Such a disposition serves to reinforce retention of the cursor 50 on a bag.

As mentioned above, in the context of the present invention, it is preferable for the leakproofing means 100 and the closure strips 20 & 22 to extend across the entire width of the bag. However, by definition, the cursor 50 occupies only a limited fraction of this width. Consequently, the cursor 50 cannot on its own urge against the leakproofing means 100 continuously over the entire length thereof.

As mentioned above, to ensure leakproofing, it is possible to consider giving the means 100 a thickness $L_1$ that is greater than the thickness $L_2$ of the closure strips 20 & 22.

Other means can be provided to apply transverse pressure P at the walls 16 & 18 on the means 100 when the bag is in its closed position in order to ensure good leakproofing. This pressure P is shown diagrammatically in FIGS. 2 and 5. Nevertheless, in this case also these dispositions can be applied to all embodiments of the present invention.

Thus, in the context of the present invention, in a variant thereof, the closure strips 20 & 22 are adapted to provide such pressure P automatically on the means 100 when the bag is closed.

Various shapes can be used for the closure strips 20 & 22 to achieve that.

When complementary closure strips of the male/female type are used as shown in FIG. 2, it is possible, for example, to provide an asymmetrical female strip, and in particular a strip in which $L_3$ is less than $L_4$, i.e. the size $L_3$ of the element 220 defining the inside lip of the female strip 22 is less than the corresponding size $L_4$ of the element 222 defining the outside lip of the female strip 22.

The person skilled in the art will understand that by means of this disposition, the inner element 220 of the female strip 22 applies stress to the leakproofing means 100 when the bag is in the closed state, i.e. when the male element 20 is engaged in the female element 22, and that this takes place along the entire length of the means 100.

A similar effect can be obtained with a male strip 20 that is asymmetrical (possibly in combination with a female strip 22 that is likewise asymmetrical as described above).

With complementary closure strips of the hook type as shown in FIG. 5, it is possible, for example, to provide for the two complementary hooks C1 & C2 situated towards the inside of the bag to define, in the assembled position, a width $L_5$ between the inside faces of the sheets 16 & 18 that is less than the width $L_6$ taken between the same faces of the sheets 16 & 18 level with the additional pair of hooks C3 & C4 situated towards the outside of the bag. This disposition makes it possible to provide the same stress over the full length of the means 100.

Figure 12:
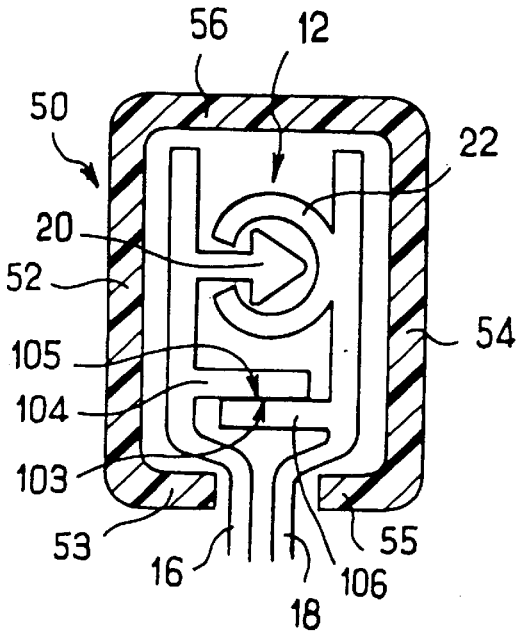
FIGS. 12 to 29 show a second series of variant embodiments of the present invention.

As shown in FIG. 12, in a variant embodiment the two elements 104 & 106 secured respectively to the inside surfaces of sheets 16 & 18 are not positioned so as to come into contact via their tips, as described above with reference to FIG. 2, but are positioned so as to be juxtaposed and so as to bear against each other via their adjacent facing flanks 103 & 105 that extend generally perpendicularly to the sheets 16 & 18.

It will be observed that in the embodiments shown in FIGS. 12 et seq, the cursor 50 is preferably provided on the ends of its side flanges 52 & 54 with respective rims 53 & 55 directed towards the inside of the bag. These rims 53 & 55 are positioned so as to be situated beyond the leakproofing means 100. The rims 53 & 55 contribute to leakproofing the bag. The rims 53 & 55 also participate in holding the cursor 50 on a bag so as to prevent unexpected removal of the cursor. As can be seen in FIG. 12, these rims 53 & 55 urge the sheets 16 & 18 towards each other, beyond the leakproofing means 100.

It will also be observed that in the embodiments shown in FIGS. 12 et seq, the portions of the support films 16 & 18 that are situated in register with the closure strips 20 & 22 and the sealing means 100 are preferably of thickness greater than the thickness of the remainder of the film constituting the bag. This greater thickness for the support films 16 & 18 in register with the cursor 50 makes it possible to hold the means 100 in their leakproofing position when the bag is in its closed position. Such localized extra thickness for the films 16 & 18 can be obtained in the form of extra thickness formed during extrusion of the film, or it can be the result of fixing support webs for the closure strips 20 & 22 or the means 100, as described above.

Figure 13:
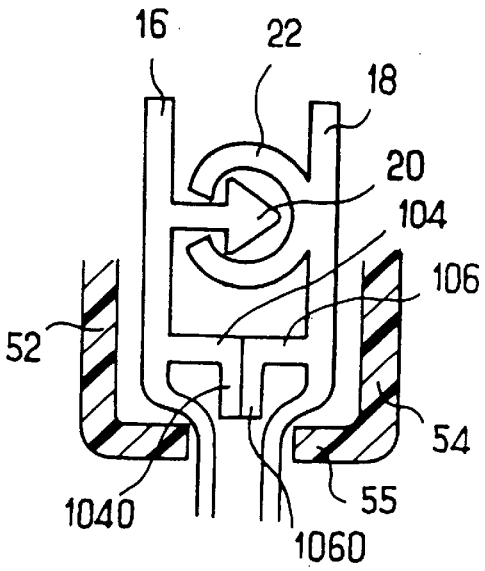

FIG. 13 shows another variant embodiment in which the two elements 104 & 106 secured to the inside surfaces of the sheets 16 & 18 respectively are provided at their tips with respective flanges 1040 & 1060 that are orthogonal to said elements. Thus said flanges 1040 & 1060 extend generally parallel to the sheets 16 & 18. The tips of the elements 104 & 106 bear against each other via the flanges 1040 & 1060.

In the embodiment of FIG. 13, said flanges 1040 & 1060 extend towards the inside of the bag. In a variant, provision can be made for the flanges 1040 & 1060 to be directed on the contrary towards the outside of the bag. In yet another variant, provision can be made for such flanges 1040 & 1060 on the tips of the elements 104 & 106 to extend both towards the inside and towards the outside of the bag. Under such circumstances, the elements 104 & 106 together with their flanges 1040 & 1060 are generally T-shaped.

Figure 14:
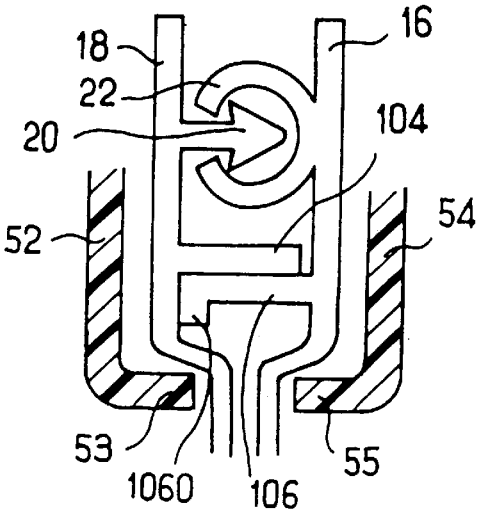

FIG. 14 shows a variant of the FIG. 12 embodiment in which at least one of the two juxtaposed elements 104 & 106 is provided at its tip with an orthogonal flange 1060. This flange is designed to rest against the inside face of the sheet 16 opposite so as to improve leakproofing. In FIG. 14, such a flange 1060 is shown on only one of the elements 106. Nevertheless, in a variant, provision can be made for such an additional flange to be provided on the tips of both elements 104 & 106 for the purpose of pressing against the inside faces of the opposite sheets.

Figure 15:
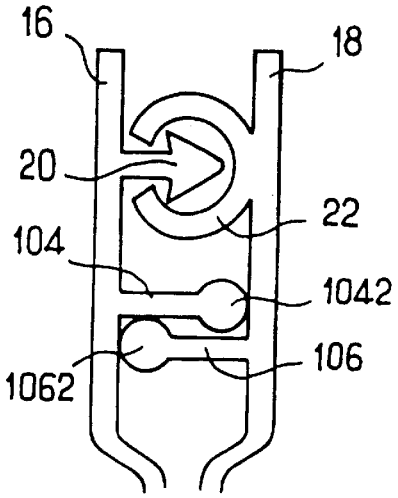

FIG. 15 shows another variant of FIG. 12 in which the two juxtaposed elements 104 & 106 are provided at their tips with rounded bulges 1042 & 1062. Each bulge is designed to rest against the inside face of the opposite sheet 16 & 18 in order to improve leakproofing. In FIG. 15, one such bulge is provided on each of the two elements 104 & 106. In a variant, such a bulge 1042 & 1062 can be provided on only one of the elements 104 & 106. In FIG. 15, these bulges are of circular right section and they are symmetrical about the midplanes of the elements 104 & 106. Nevertheless, the invention is not limited to that particular shape.

Figure 16:
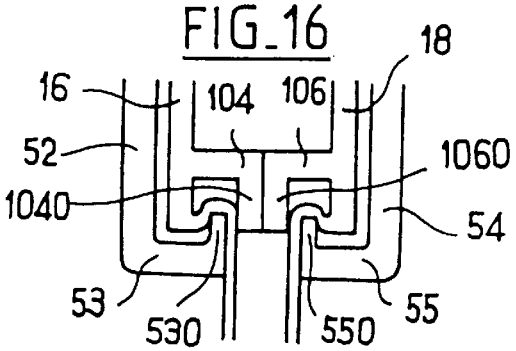

FIG. 16 shows a variant of FIG. 13 in which the cursor 50 is also provided at the ends of each of the rims 53 & 55 with additional flanges 530 & 550 that are directed towards the web 56 of the cursor 50, i.e. towards the outside of the bag. These flanges 530 & 550 thus extend generally parallel to the side flanges 52 & 54 of the cursor 50. These additional flanges 530 & 550 are designed to occupy positions in the volume defined between the sheets 16 & 18 and the flanges 1040 & 1060 of the leakproofing means 100. On examining FIG. 16, it will be understood that these flanges 530 & 550 serve to crease the sheets 16 & 18, thereby further reinforcing the leakproofing of the resulting bags.

In the embodiments described above, the cursor 50 is symmetrical about a longitudinal plane. Thus, in FIGS. 12 to 14, its flanks 52 & 54 are provided with respective rims 53 & 55.

Figure 17:
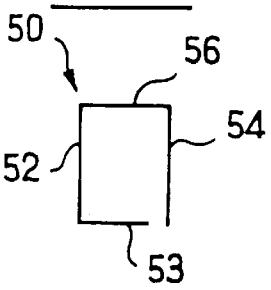

However, in the variant shown in FIG. 17, the cursor is asymmetrical in that only one of its flanks, its flank 52, is provided with a rim 53 that extends towards the inside of the bag.

Figure 18:
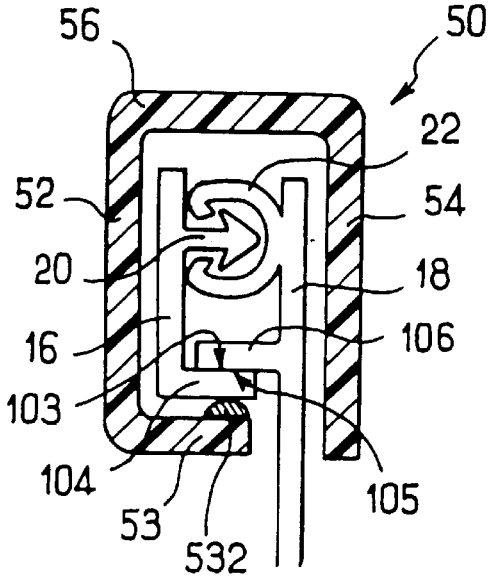

FIG. 18 shows a variant of the FIG. 17 embodiment in which said rim 53 is provided on its inside face with a bead 532 directed towards the web 56 so as to urge the two juxtaposed elements 104 & 106 to bear against each other via their adjacent flanks 103 & 105. For this purpose, the bead 532 exerts force on the element 104 that is directed towards the web 56.

Figure 19:
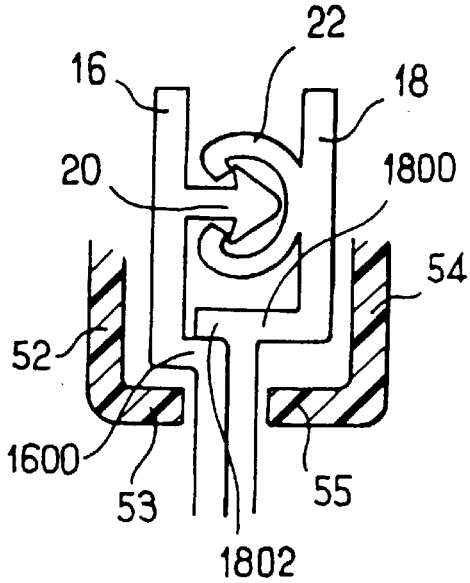

FIG. 19 shows another variant embodiment in which the portions of the support films 16 & 18 that carry the closure strips 20 & 22 and the leakproofing means 100 are not situated directly in line with the sheets constituting the body of the bag, but are offset towards the outside of the bag via respective setbacks 1600 & 1800. These setbacks 1600 & 1800 can be obtained by extrusion while manufacturing the film, or they can be obtained subsequently by folding the film. On examining FIG. 19, it will be understood that such setbacks 1600 & 1800 can facilitate juxtaposing the sheets 16 & 18 at the outlet from the cursor 50 even though the sheets 16 & 18 are necessarily separated from each other inside the cursor because of the presence of the closure strips 20 & 22 and of the means 100.

On examining FIG. 19, it will also be observed that, where appropriate, one of the setbacks 1800 can itself be provided with an extension 1802 directed towards the opposite support sheet 16. This extension 1802 is designed to rest against the opposite setback 1600 so as to further reinforce the leakproofing of the resulting bags.

Figure 20:
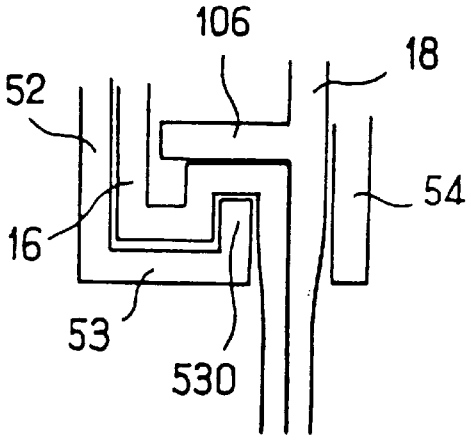

FIG. 20 shows a variant embodiment in which provision is made firstly for a bead 530 or inwardly-directed rim on the cursor on its single rim 53, and secondly for an element 106 projecting from the sheet 18. Thus, as can be seen in FIG. 20, the bead 530 imparts a curve or baffle-path to the second sheet 16 on leaving the cursor 50 suitable for further improving leakproofing of the resulting bag.

Figure 21:
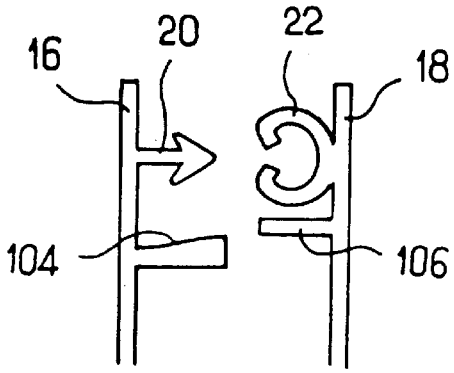

FIG. 21 shows a variant of the FIG. 12 embodiment in which at least one of the two elements 104 & 106 is of thickness that increases going towards its tip, or possesses a sloping flank such that it exerts a force on the other juxtaposed elements 106 & 104 when the bag is in its closed position.

Figure 22:
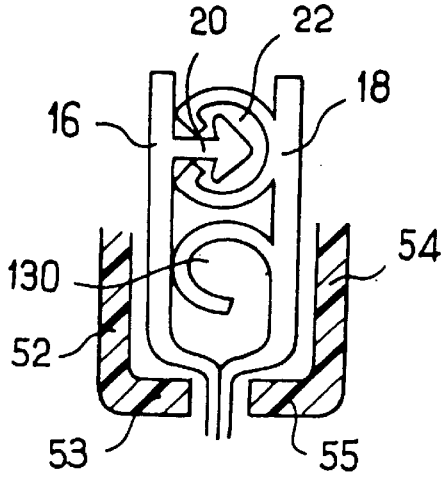

FIG. 22 et seq show variant embodiments in which the leakproofing means 100 are essentially formed by structures that are flexible and resilient, so as to be deformable while the bag is being closed, whereas in the embodiments shown in FIGS. 12 to 21, the means 100 are essentially rigid.

Thus, FIG. 22 shows a variant embodiment in which the leakproofing means 100 comprise a flexible and resilient curved lip 130 secured to the sheet 18 that carries the female closure strip 22.

In a variant, such a flexible and resilient lip 130 can be secured to the sheet 16 which carries the male closure strip 20.

In FIG. 22, the lip 130 is constituted by a sector of a cylinder subtending an angle at the center of more than 180°. In FIG. 22, the concave side of the lip 130 is directed towards the inside of the bag. Nevertheless, in a variant, it is possible to provide for the concave side of the lip 130 to be directed towards the outside of the bag.

Figure 23:
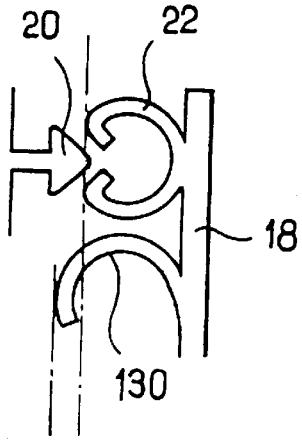

As can be seen in FIG. 22, when the bag is in its closed position, the tip of the lip 130 rests against the opposite support sheet 16. As can be seen in FIG. 23, when the bag is open, said lip 130 extends beyond the associated closure strip 22. This disposition guarantees that when the bag is in the closed state, said lip 130 exerts pressure on the opposite sheet 16.

Figure 24:
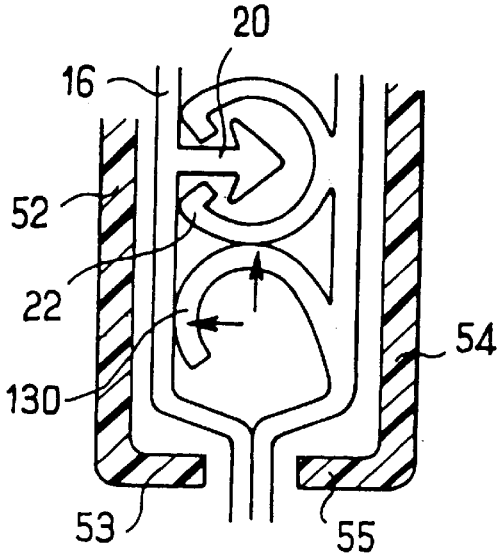

FIG. 24 shows a variant of the FIG. 22 embodiment in which the position of the lip 130 and the shape of the lip 130 are such that when said lip 130 is resting against the opposite sheet 16 it receives a reaction which urges it itself to press against one of the closure strips, and specifically the female closure strip 22 in this case.

Figure 25:
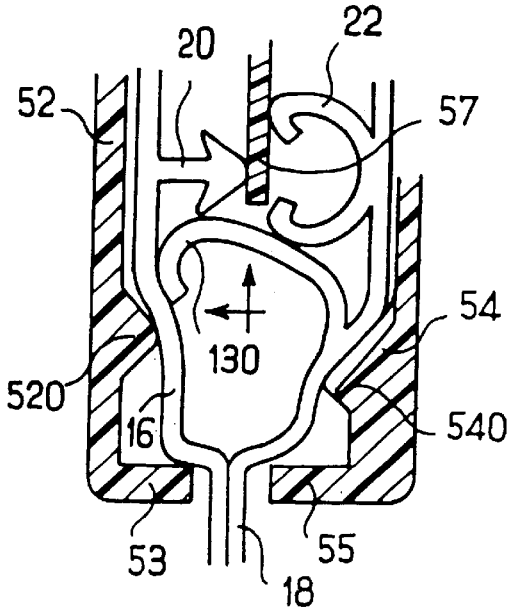

FIG. 25 shows another variant embodiment in which such urging of the lip 130 to bear against the female closure element 22 is reinforced by the presence on the inside surfaces of the flanks 52 & 54 of the cursor 50 of beads 520 & 540. Specifically, as shown in FIG. 25, these beads 520 & 540 are generally triangular in profile. Nevertheless, the beads 520 & 540 are not limited to that particular shape and can be embodied in a wide variety of ways.

It will be observed in FIG. 25 that the central tongue of the cursor 50 which controls both engagement and disengagement of the closure strips 20 & 22 is referenced 57.

Figure 26:
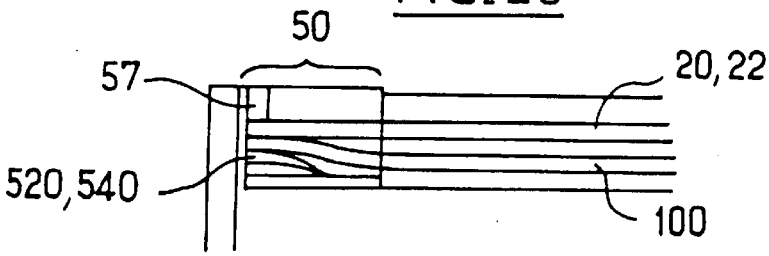

FIG. 26 is a side view of the bag when fitted in this way. In this FIG. 26, there can be seen a cursor 50 that has such pressure-applying beads 520 & 540 and there can also be seen the closure strips 20 & 22 and the leakproofing means 100. On examining FIG. 26, it will be observed that the beads 520 & 540 preferably extend over a portion only of the length of the cursor 50 and that they converge towards the top web 56 of the cursor 50 on moving closer to the end of the cursor 50 that is situated adjacent to the opening of the bag. By means of this disposition, the beads 520 & 540 urge the lip 130 to press against the closure strip 22 in the vicinity of the open zone of the bag.

Similarly, the rims 53 & 55 provided on the flanges 52 & 54 of the cursor 50 can converge towards the web 56 as they come closer to the end of the cursor 50 which is situated adjacent to the opening of the bag, for the purpose of improving bag leakproofing at this point.

Figure 27:
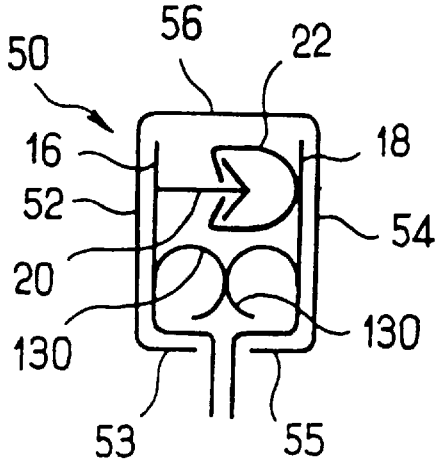

FIG. 27 shows another variant embodiment in which each of the two sheets 16 & 18 is provided on its inside surface with a resilient lip 130 in the form of a cylindrical sector. These two lips 130 thus have their tips bearing against each other when the bag is closed.

Figure 28:
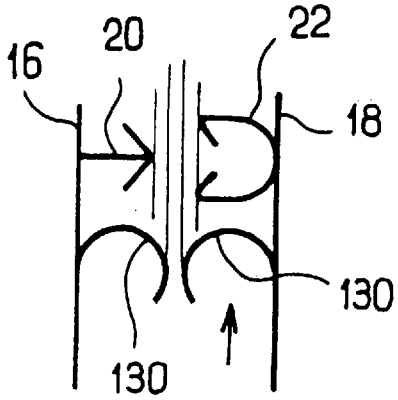

In this case also, to achieve this effect at least one of the two lips 130 when in the rest position, i.e. when the bag is open, preferably extends beyond the associated closure strip, as shown diagrammatically in FIG. 28.

The cursor 50 used in the variant embodiment of FIG. 27 can also include pressure-applying beads 520 & 540 that extend upwards, as shown in FIG. 26, so as to urge the resilient lips 130 against the closure strips 20 & 22 when the bag is in its closed position.

Figure 29:
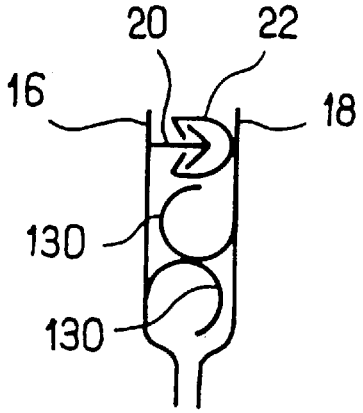

FIG. 29 shows another variant embodiment in which each of the two support films 16 & 18 is provided with a resilient lip 130, but in this case the lips are not positioned so as to come into contact with each other via their tips, but so as to be juxtaposed laterally, as can be seen in FIG. 29. For this purpose, the two lips 130, each formed by a cylindrical sector having an angle at the center of more than 180°, have their respective concave sides directed one towards the inside and the other towards the outside of the bag.

The description below relates to the variant embodiment shown in accompanying FIGS. 30 to 39.

As mentioned above, in these variants, the bag has means 150 at its mouth 12, said means 150 being situated on the opposite side of the closure strips 20 & 22 to said additional leakproofing means 100 and being adapted to ensure pressure is applied between facing inside faces of the walls of the bag. In addition, the cursor 50 is provided with means suitable for urging the walls of the bag inwards in a zone of said walls that extends between the additional leakproofing means 100 and the thrust means 150. This guarantees that said additional means 100 are urged into a leakproofing position by the cursor 50. This urging is preferably performed in register with the closure strips 20 & 22.

As can be seen in the accompanying figures, it is thus preferable for the additional leakproofing means 100 to be situated on the inside of the closure strips 20 & 22 while the thrust-defining means 150 are situated on the outside of said closure strips 20 & 22.

This disposition having means 150 associated with the means enabling the cursor 50 to press together the leakproofing means 100 can be applied to all of the variant embodiments described above. They are therefore not limited to the embodiments of FIGS. 30 to 39. In particular, this disposition applies to any type of leakproofing means 100, to any type of closure strip 20 & 22, and to all variants of the cursor 50, or to a bag fitted with a tamperproofing web, etc. . . .

Figure 30:
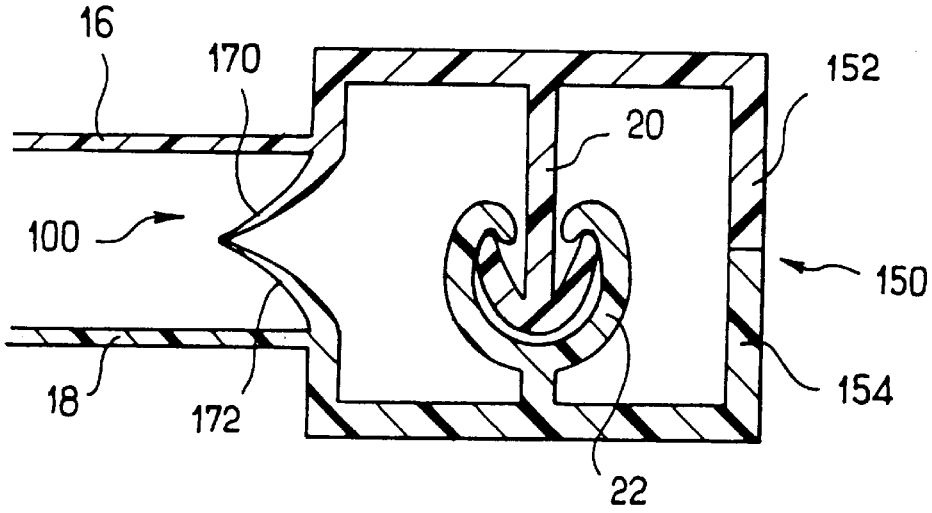
FIGS. 30 to 39 show a third series of variant embodiments of the present invention.

FIG. 30 shows a variant in which the additional leakproofing means 100 are formed by two flexible resilient lips 170 & 172 that are secured to the respective inside faces of the walls 16 & 18, and that extend towards the inside and towards the bottom of the bag. In a variant, these lips 170 & 172 can be directed towards the inside of the cursor 50 (in particular with bags containing a vacuum, for example). As mentioned above, the disposition having thrust means 150 applies to any type of leakproofing means 100 and is not limited to the means 100 shown in FIG. 30. In particular, it applies to lips 170 & 172 that are not symmetrical.

Similarly, in FIG. 30, the closure strips 20 & 22 are of the male/female type. Nevertheless, the invention applies to any type of closure strip, and in particular to hook-type strips.

In FIG. 30, the thrust means 150 are constituted by two symmetrical elements 152 & 154 secured to respective inside faces of the walls 16 & 18 at the mouth of the bag. More precisely, and still with reference to FIG. 30, each of these elements 152 & 154 has a rectangular right section that extends towards the midplane of the bag where said elements come to bear against each other, when the bag is in its closed position. Thus, these elements 152 & 154 extend generally perpendicularly to said midplane.

It will be observed that in FIG. 30, the means 100, the strips 20 & 22, and the means 150 are integrally formed with the walls 16 & 18 of the same material(s), preferably by extrusion. More precisely, it will be observed that the segments of the walls that extend between the leakproofing means 100 and the thrust means 150 are thicker than the sheets 16 & 18 constituting the remainder and the major portion of the bags. Thus, the above-mentioned segments are somewhat stiff between the means 100 and the means 150.

The person skilled in the art will understood that by means of the above-mentioned characteristics, when the elements 152 & 154 are pressed against each other and the cursor 50 is pressing against the above-mentioned segments of the walls 16 & 18 situated between the means 100 and 150, the leakproofing means 100 are themselves urged into their position of contact and maximum leakproofing.

Figure 31:
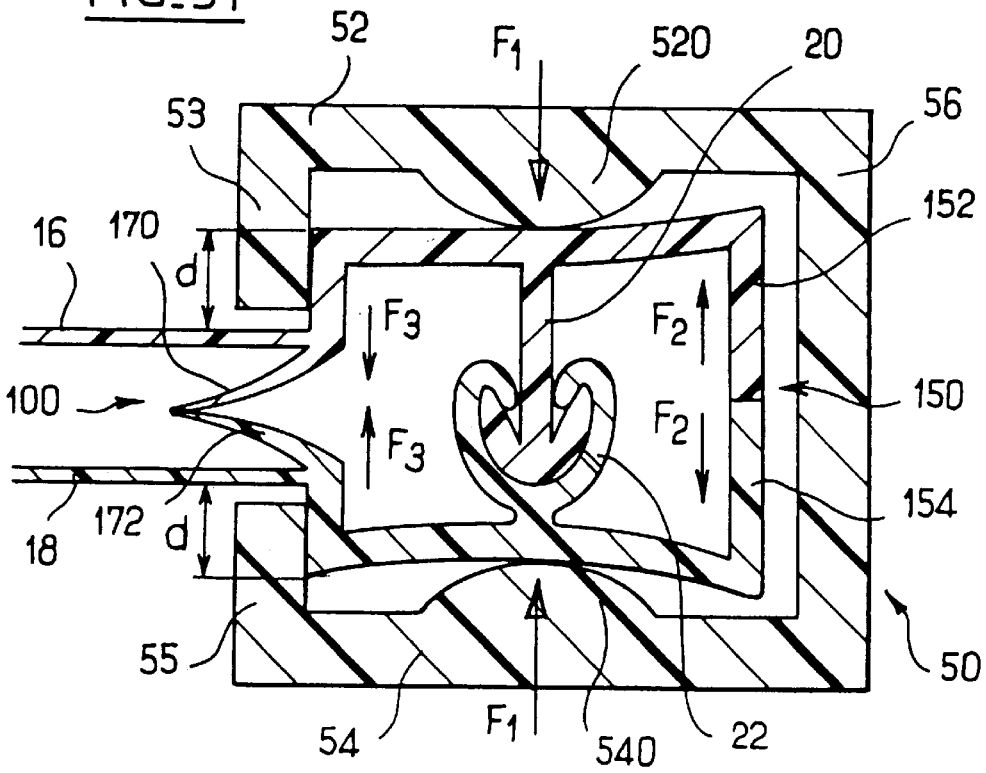

In FIG. 31, there can be seen the urging means provided on the cursor 50 in the form of beads 520 & 540 provided on the inside surfaces of the flanges 52 & 54 in register with the closure strips 20 & 22. In this case, the beads are in the form of cylindrical caps, but the invention is not limited to that particular shape.

In FIG. 31, the force exerted by the cursor 50 on the mouth segments of the bag walls is referenced $F_1$, the reaction due to the means 150 is referenced $F_2$, and the force then exerted on the leakproofing means 100 is referenced $F_3$.

It will also be observed in FIG. 31 that the above-mentioned segments define a cage in the vicinity of the mouth of the bag, which cage has a right section that is rectangular and that projects from the main walls 16 & 18 of the bag. In other words, the main walls of the bag are not coplanar with the outside surfaces of the segments, but are set back inwards therefrom by a distance d. A setback is thus defined in the walls 16 & 18 which serves as a bearing surface for the rims 53 & 55 provided on the flanges 52 & 54 of the cursor 50 so as to prevent the cursor being removed unexpectedly.

Figure 32:
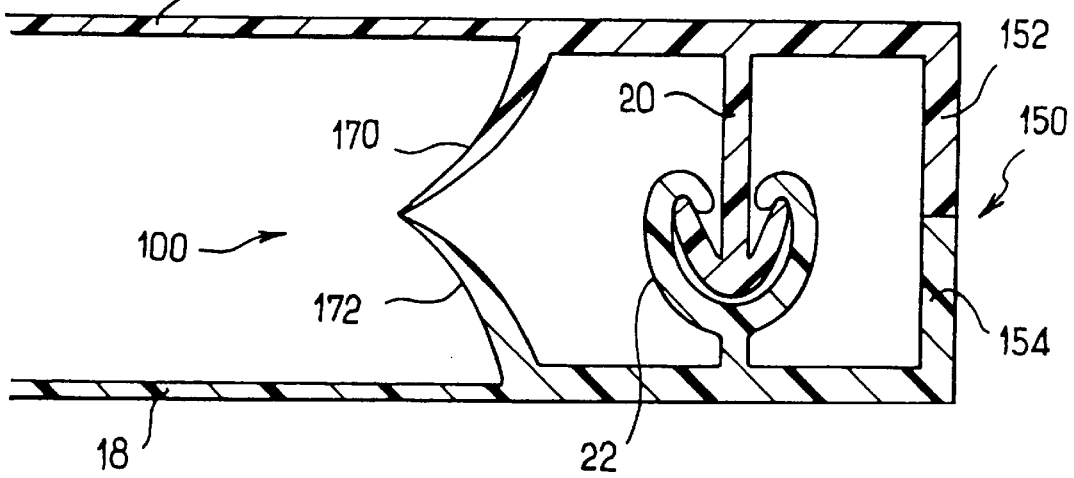

FIG. 32 shows a variant in which such a setback is omitted. Thus, in FIG. 32, the main walls of the bag when at rest are, on the contrary, coplanar with the outside surfaces of the segments situated between the means 100 and 150. Nevertheless this variant can also co-operate with a cursor 50 having rims 53 & 55 on its flanges 52 & 54, because it is possible to deform the sheets 16 & 18.

Figure 33:
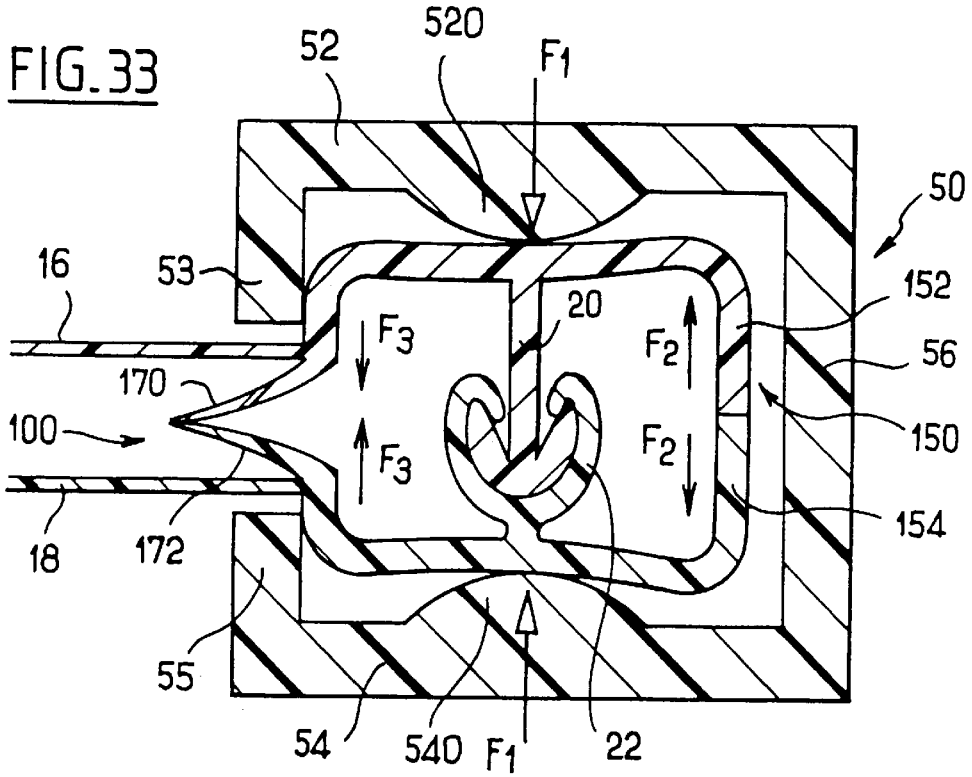

In the variant shown in FIG. 33, the above-mentioned segments between the means 100 and 150 do not define a cage of rectangular right section at the mouth of the bag, but define a cage that is generally rounded.

Figure 34:
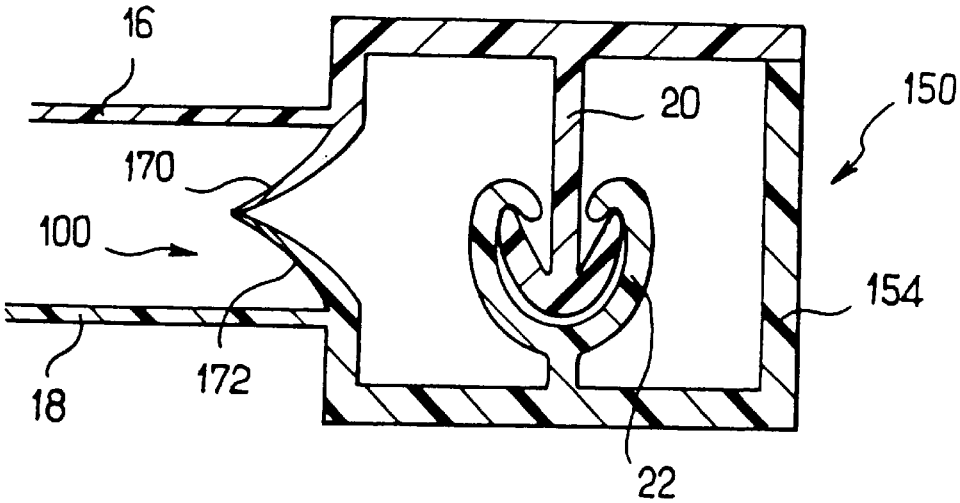

In above-described FIGS. 30 to 33, the thrust elements 152 & 154 are symmetrical and make contact with each other in the midplane of the bag. In a variant, these elements 152 & 154 can be asymmetrical, thereby making contact with each other away from the midplane. FIG. 34 thus shows a variant in which only the wall 18 is provided with a thrust element 154 projecting from its inside face. This element 154 is adapted to rest against the inside face of the opposite wall 16.

Figure 35:
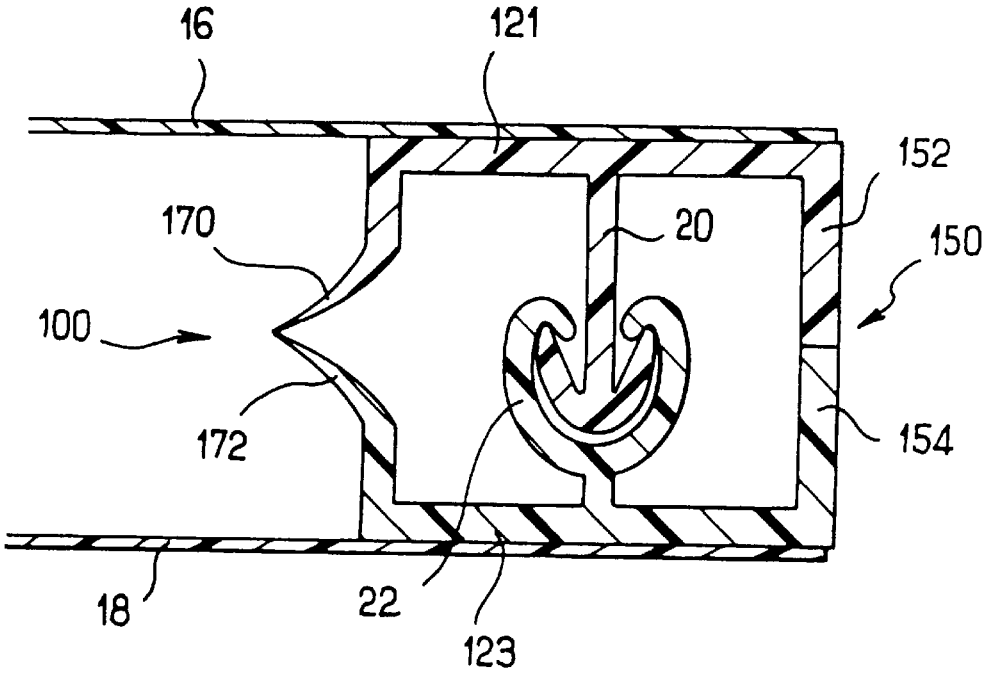

In above-described FIGS. 30 to 34, the leakproofing means 100, the closure strips 20 & 22, and the thrust means 150 are integrally formed by extrusion out of the same material(s) as the walls 16 & 18. In a variant, these various means can be supplied on respective support webs that are then secured to the inside faces of the sheets 16 & 18, e.g. by heat sealing or adhesive. These webs can be respective separate support webs for each of the means 100, strips 20 & 22, and means 150, or else support webs that are common to a plurality of these means. Thus, for example, FIG. 35 shows a variant embodiment in which the means 100, the closure strips 20 & 22, and the thrust means 150 are carried by two respective webs, one of which is fixed to the inside face of the sheet 16 and the other of which is fixed to the inside face of the sheet 18.

Figure 36:
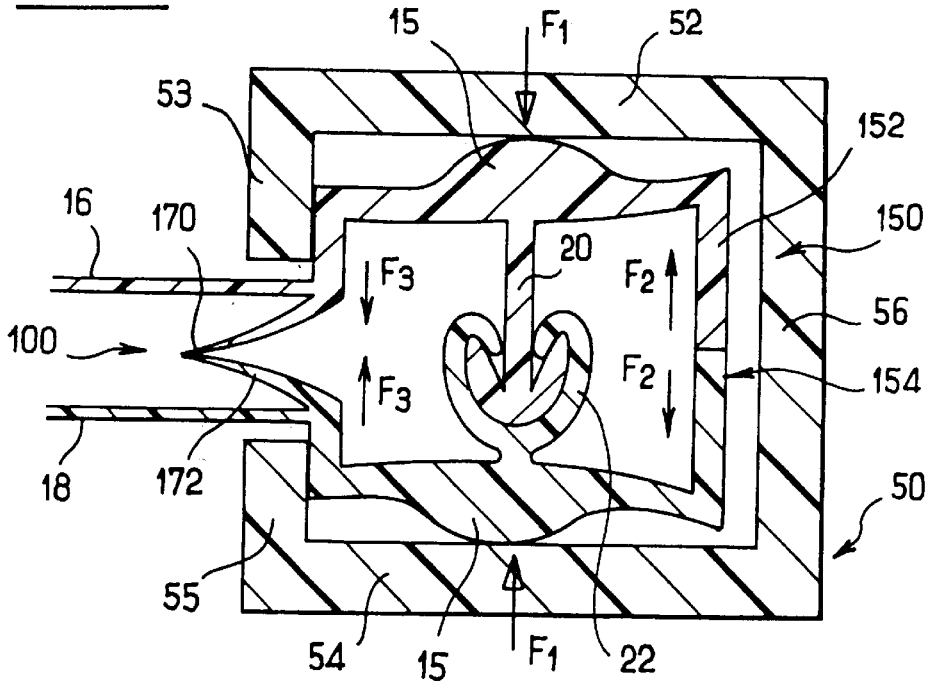

FIG. 36 shows a variant embodiment in which the urging means are formed not by beads secured to the inside faces of the flanges of the cursor, but by beads 15 projecting from the outside faces of the wall segments situated between the means 100 and 150, preferably in register with the closure strips 20 & 22. In yet another variant, it is thus possible to provide beads simultaneously on the cursor and on the walls of the bag.

Figure 37:
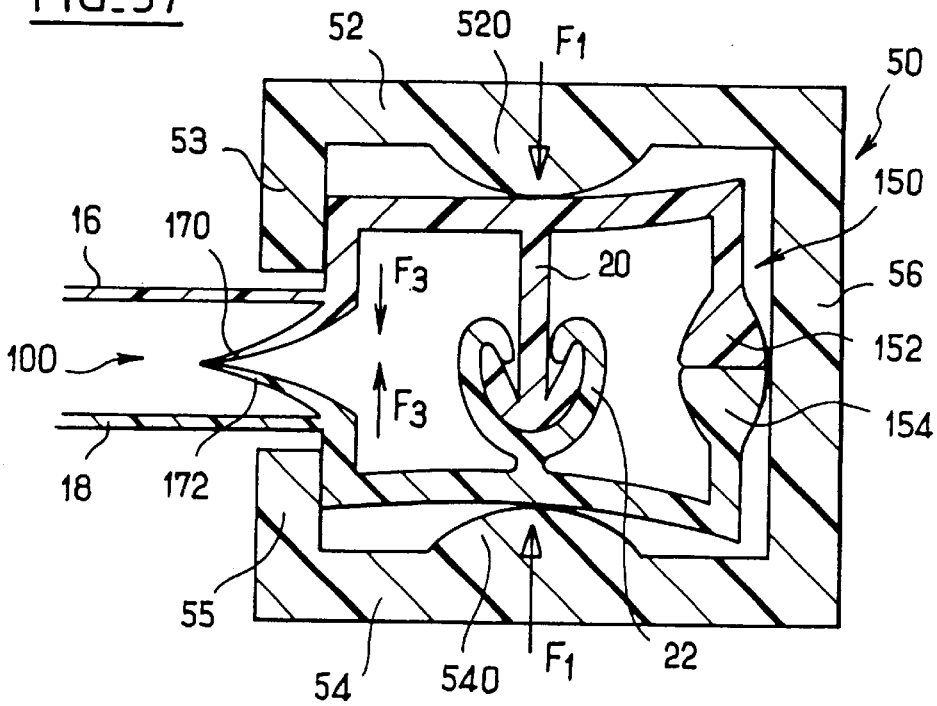

FIG. 37 shows another variant embodiment in which the facing ends of the thrust means forming the elements 152 & 154 are enlarged so as to guarantee that they bear against each other and so as to ensure that these elements are not shifted so as to be no longer adjacent, since under such circumstances the lever arms required for exerting thrust on the means 100 would not be obtained. In FIG. 37, the adjacent ends of the elements 152 & 154 are of generally triangular right section with the base of each triangle being situated in the plane of contact. Nevertheless, the invention is not limited to this particular disposition.

Figure 38:
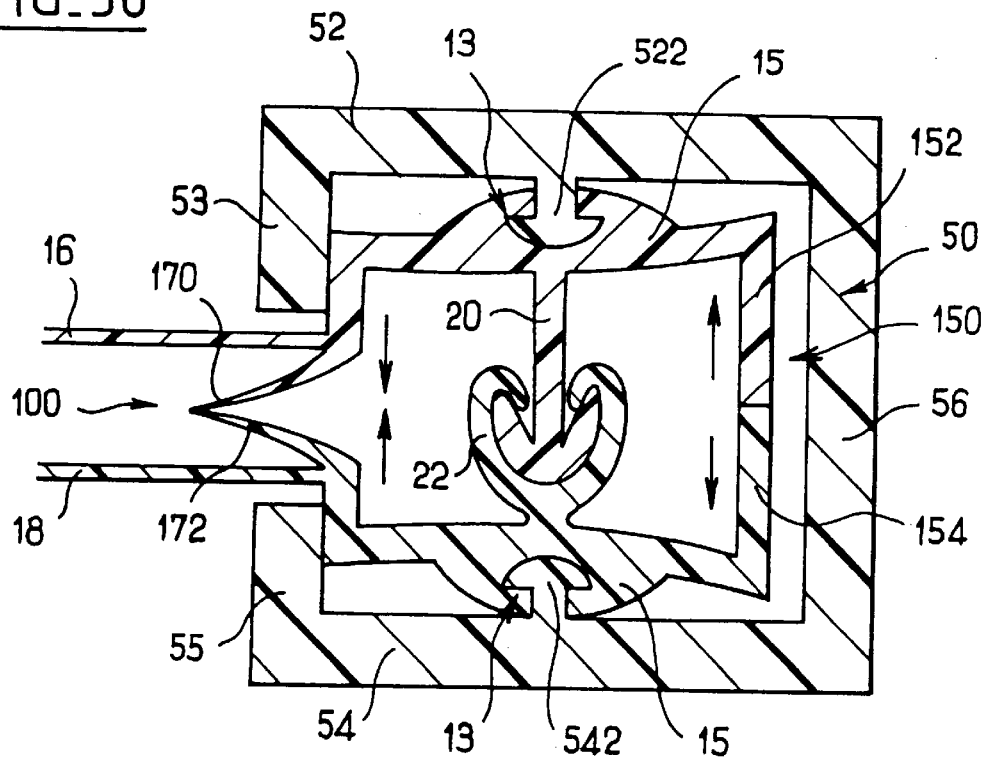

FIG. 38 shows a variant in which the cursor 50 is fitted on the inside faces of its flanges 52 & 54 with projecting structures 522 & 542 of right section complementary to grooves 13 formed in the above-mentioned beads 15, the structures 522 & 542 being engaged in said grooves 13. Still more precisely, the structures 522 & 542 flare while the grooves 13 have edges that converge. This disposition serves to prevent unwanted removal of the cursor 50.

Figure 39:
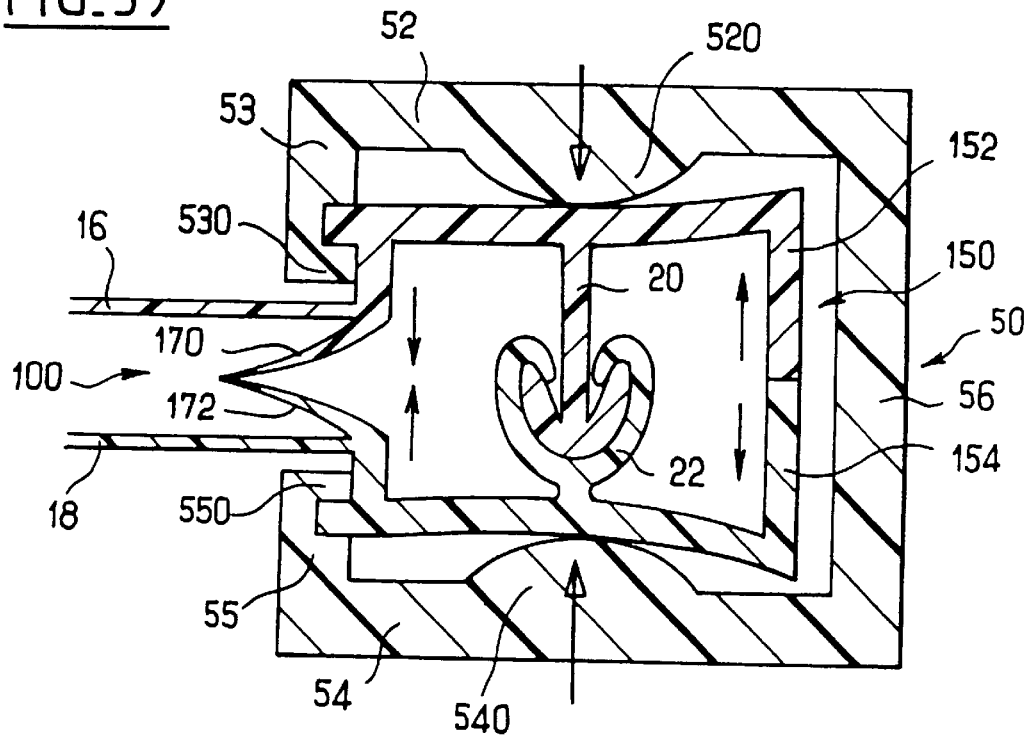
Figure 40:
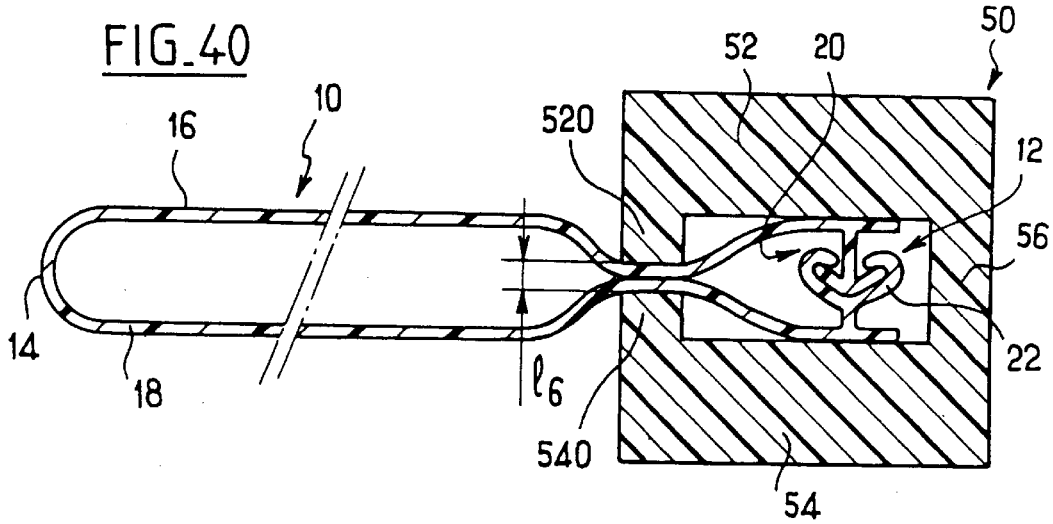
FIGS. 40 to 42 are three diagrammatic cross-section views of a bag fitted with a cursor of the present invention, on views given references I—I, II—II, and III—III respectively in FIG. 43.
Figure 41:
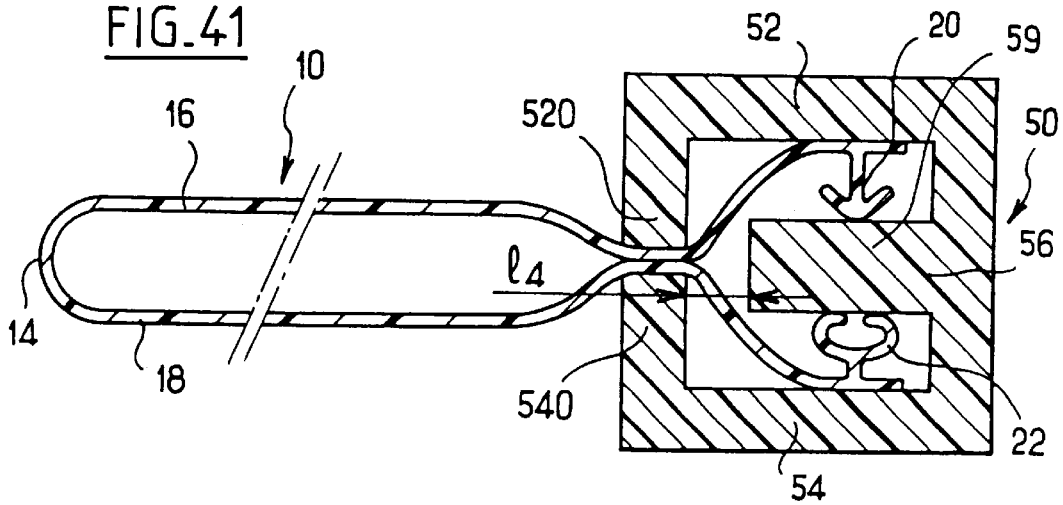
Figure 42:
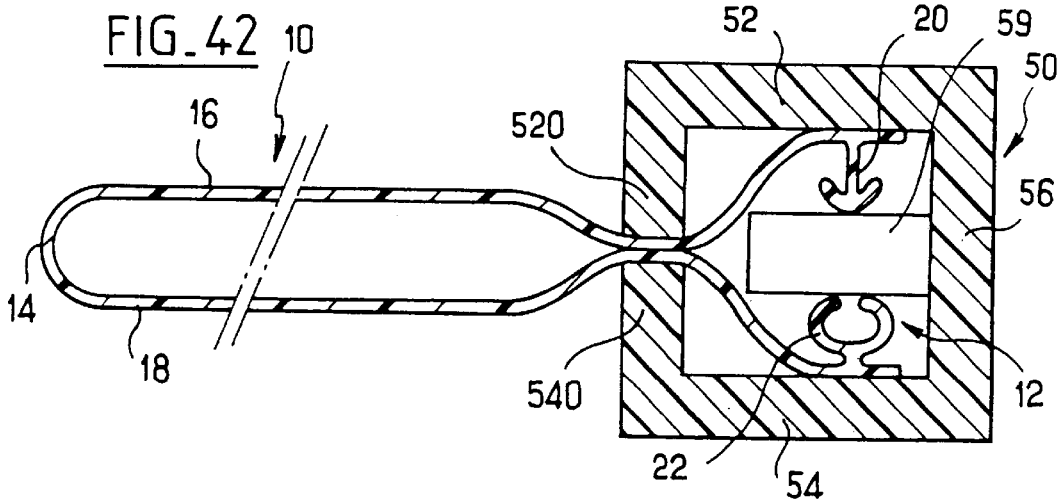
Figure 43:
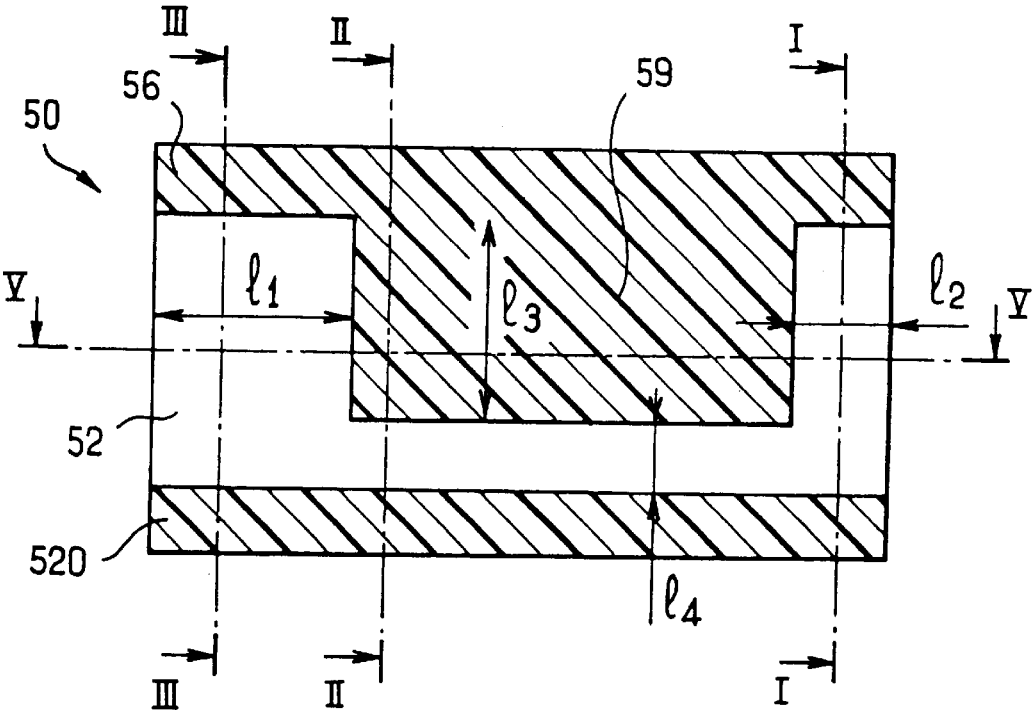
FIG. 43 is a longitudinal mid-section view of a cursor of the present invention, on a section plane referenced IV—IV in FIGS. 40 to 42.
Figure 44:
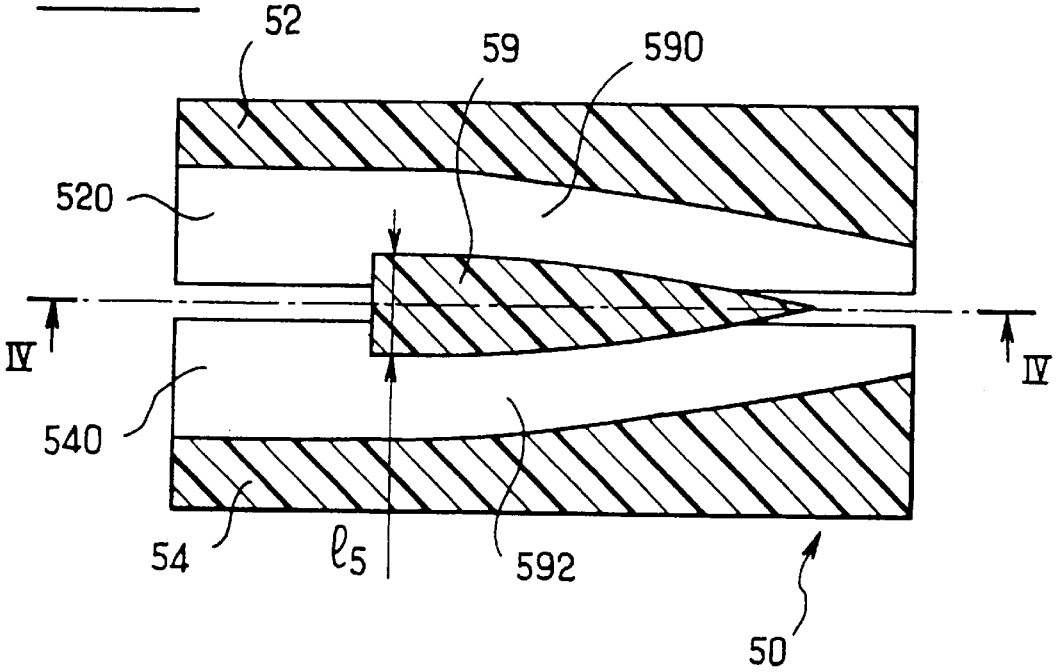
FIG. 44 is another longitudinal section view of the cursor on a section plane referenced V—V in FIG. 43.

FIG. 39 shows another variant embodiment in which complementary shape means are defined between the cursor 50 and the walls of the bag in the vicinity of the rims 53 & 55 formed on the flanges 52 & 54, in the form of elements 530 & 550 of the kind described above.

Where appropriate, the elements constituting the leakproofing means 100 can be coextruded with the bag and/or the closure strips, out of a material that is more flexible than the material forming the other portions. For example, the lips 170 & 172 can be coextruded out of a copolymer of ethylene or using a synthetic elastomer.

As mentioned above, the present invention is naturally not limited to the particular embodiments described above, but it extends to any variant within the spirit of the invention.

The term "fleakproofing" is used in the context of the present invention to indicate that the means 100 are adapted (by their shape and/or their thrust force) either to provide a complete barrier preventing any penetration from the outside towards the inside of the bag or any leakage from the inside towards the outside of the bag, or else to act as means that provide a barrier in one direction, i.e. to prevent penetration from the outside towards the inside of the bag, or to prevent leakage from the inside towards the outside of the bag.

It should also be observed that the rim means 53 & 55 and the structures such as 522 & 542 provided on the bag and contributing to holding the cursor 50 on the bag are generally not the only structures that provide such holding, but for example provide assistance for this purpose for flared means provided in the central tongue of the cursor 50.

The person skilled in the art will also understand that in the embodiments shown in FIGS. 30 to 39, the leakproofing means 100 need not be placed facing the flanks 52 & 54 of the cursor, but can be placed outside them. In other words, under such circumstances, the end of the cursor is situated between said means 100 and the closure strips 20 & 22.

As mentioned above, in a variant embodiment the tongue 59 is interrupted before the longitudinal end of the cursor (i.e. the tongue is set back from the end), at least at the broader end of the cursor which corresponds to the diverging end of the passages 590 & 592, as can be seen in particular in FIGS. 40, 42, 43, and 44, and the side flanges 52 & 54 are provided in the vicinity of their free edges remote from the web 56 with urging means 520 & 540 for urging the sheets 16 & 18 of the bag towards each other, which means cover the entire longitudinal extent of the tongue 59 and extend longitudinally beyond the ends of the tongue, so as to ensure that the bag is leakproof when in the closed position.

In the preferred embodiment shown in FIGS. 40 to 43, these urging means are constituted by ribs 520 & 540 projecting towards the inside of the cursor 50 from the edges of the flanges 52 & 54 remote from the web 56, or where appropriate from part of the way along the height of the inside surfaces of the flanges 52 & 54 lying between the web 56 and the free edges of the flanges 52 & 54. It will be observed that although the ribs 520 & 540 are not necessarily situated at the free edges of the side flanges 52 & 54, these ribs 520 & 540 are nevertheless situated beyond the tongue 59 (i.e. between the tip of the tongue 59 remote from the web 56 and the free edges of the flanges 52 & 54), so that the ribs are not level with the tongue.

The ribs 520 & 540 overlie the tongue 59 without discontinuity and extend beyond it, at least at the broader end of the tongue 59 corresponding to the diverging end of the passage 590 & 592. More precisely, in the preferred embodiment shown in the accompanying figures, the ribs 520 & 540 extend over the full length of the cursor 50 while the tongue 59 is interrupted at its broader end (diverging end of the passages 590 & 592) at a distance $l_1$ from the end of the cursor 50, while at its narrower end (converging end of the passages 590 & 592), it terminates at a distance $l_2$ from the end of the cursor 50.

The width $l_6$ of the empty space defined between the tips of the ribs 520 & 540 is substantially equal to the sum of the thicknesses of the sheets 16 & 18 at the mouth of the bag. Thus, the cursor 50 urges the sheets towards each other beneath the tip of the tongue 59, thereby guaranteeing that the bag is leakproof.

In the embodiment shown in accompanying FIGS. 40 to 44, two ribs 520 & 540 are provided that are symmetrical and of the same height, one rib on each of the flanges 52 & 54. In a variant, ribs 520 & 540 can be provided that are asymmetrical. Thus, it is possible to provide a single rib on only one of the flanges 52 & 54 of the cursor 50.

In the figures, the following are referenced:

$l_3$ the height of the tongue 59 measured parallel to the flanges 52 & 54 and perpendicularly to the web 56;

$l_4$ the distance between the free tip of the tongue 59 remote from the web 59 and the ribs 520 & 540; and $l_5$ the width of the tongue 59 at its broader end.

In the context of the present invention:

$l_1$ preferably lies in the range 1 mm to 10 mm, and is most preferably about 3 mm;

$l_2$ preferably lies in the range 0.5 mm to 10 mm, and is most preferably about 4 mm;

$l_3$ preferably lies in the range 2 mm to 7 mm, and is most preferably about 3 mm;

$l_4$ preferably lies in the range 5 mm to 15 mm, and is most preferably about 8 mm;

$l_5$ preferably lies in the range 0.3 mm to 2 mm, and is most preferably about 0.5 mm; and $l_6$ preferably lies in the range 50 $\mu$m to 2.5 mm, and is most preferably about 200 $\mu$m.

In the context of the present invention:

the ratio $l_1/l_5$ preferably lies in the range 0.5 to 30, and is most preferably about $_6$;

the ratio $l_2/l_5$ preferably lies in the range 2.5 to 30, and is most preferably about 8;

the ratio $l_1/l_3$ preferably lies in the range 0.5 to 5, and is most preferably about 1;

the ratio $l_2/l_3$ preferably lies in the range 0.1 to 5, and is most preferably about 1.3;

the ratio $l_1/l_4$ preferably lies in the range 0.05 to 2, and is most preferably about 0.4; and the ratio $l_2/l_4$ preferably lies in the range 0.05 to 2, and is most preferably about 0.5.

What is claimed is:

1. A bag having two generally parallel sheets forming main walls of the bag, complementary closure strips fixed to respective ones of the sheets, and a cursor for actuating the strips for closing and opening purposes, the bag comprising, parallel to the closure strips, between said sheets, and level with a mouth of the bag, leakproofing structure in relief disposed on an inside of the closure strips, designed to provide sealing by forming a barrier between the sheets in a closed position of the bag, said leakproofing structure in relief being adapted to be urged towards a sealing position by the cursor when the cursor is moved towards a position for closing the bag, and in a vicinity of the mouth, thrust means situated on a side of the closure strips opposite from a side on which said leakproofing structure being situated for providing thrust between opposing inside faces of the walls of the bag, and urging means provided on the cursor for urging the walls of the bag inwards in a zone of said walls lying between the leakproofing structure and the thrust means, the walls of the bag having beads faced in register with the leakproofing structure and in register with flanks of the cursor to guarantee that the leakproofing structure is urged into a leakproofing position when the bag is closed.

2. A bag having two generally parallel sheets forming main walls of the bag, complementary closure strips fixed to respective ones of the sheets, and a cursor for actuating the strips for closing and opening purposes, the bag comprising, parallel to the closure strips, between said sheets, and level with a mouth of the bag, leakproofing structure in relief disposed on an inside of the closure strips, designed to provide sealing by forming a barrier between the sheets in a closed position of the bag, said leakproofing structure in relief being adapted to be urged towards a sealing position by the cursor when the cursor is moved towards a position for closing the bag, and in a vicinity of the mouth, thrust means situated on a side of the closure strips opposite from a side on which said leakproofing structure being situated for providing thrust between opposing inside faces of the walls of the bag, and urging means provided on the cursor for urging the walls of the bag inwards in a zone of said walls lying between the leakproofing structure and the thrust means, grooves opening out to an outside surface of the bag, respectively in register with the leakproofing structure, and also ribs projecting from inside surfaces of flanks of the cursor, which ribs are adapted to penetrate respectively into said grooves.

3. A bag having two generally parallel sheets forming main walls of the bag, complementary closure strips fixed to respective ones of the sheets, and a cursor for actuating the strips for closing and opening purposes, the bag comprising, parallel to the closure strips, between said sheets, and level with a mouth of the bag, leakproofing structure in relief disposed on an inside of the closure strips, designed to provide sealing by forming a barrier between the sheets in a closed position of the bag, said leakproofing structure in relief being adapted to be urged towards a sealing position by the cursor when the cursor is moved towards a position for closing the bag, and in a vicinity of the mouth, thrust means situated on a side of the closure strips opposite from a side on which said leakproofing structure being situated for providing thrust between opposing inside faces of the walls of the bag, and urging means provided on the cursor for urging the walls of the bag inwards in a zone of said walls lying between the leakproofing structure and the thrust means, the leakproofing structure for providing leakproofing being made up of two elements respectively secured to inside surfaces of the two sheets of the bag and designed to bear against each other via tips.

4. A bag having two generally parallel sheets forming main walls of the bag, complementary closure strips fixed to respective ones of the sheets, and a cursor for actuating the strips for closing and opening purposes, the bag comprising, parallel to the closure strips, between said sheets, and level with a mouth of the bag, leakproofing structure in relief disposed on an inside of the closure strips, designed to provide sealing by forming a barrier between the sheets in a closed position of the bag, said leakproofing structure in relief being adapted to be urged towards a sealing position by the cursor when the cursor is moved towards a position for closing the bag, and in a vicinity of the mouth, thrust means situated on a side of the closure strips opposite from a side on which said leakproofing structure being situated for providing thrust between opposing inside faces of the walls of the bag, and urging means provided on the cursor for urging the walls of the bag inwards in a zone of said walls lying between the leakproofing structure and the thrust means, the cursor being provided on an end of at least one of its side flanges with a rim directed towards an inside of the bag and positioned so as to be situated beyond the leakproofing structure, the cursor being also provided at the end of said rim with an additional flange directed toward a web of the cursor.

5. A bag having two generally parallel sheets forming main walls of the bag, complementary closure strips fixed to respective ones of the sheets, and a cursor for actuating the strips for closing and opening purposes, the bag comprising, parallel to the closure strips, between said sheets, and level with a mouth of the bag, leakproofing structure in relief disposed on an inside of the closure strips, designed to provide sealing by forming a barrier between the sheets in a closed position of the bag, said leakproofing structure in relief being adapted to be urged towards a sealing position by the cursor when the cursor is moved towards a position for closing the bag, and in a vicinity of the mouth, thrust means situated on a side of the closure strips opposite from a side on which said leakproofing structure being situated for providing thrust between opposing inside faces of the walls of the bag, and urging means provided on the cursor for urging the walls of the bag inwards in a zone of said walls lying between the leakproofing structure and the thrust means, the urging means comprise beads on inside surfaces of flanges of the cursor.

6. A bag according to claim 5, wherein the beads are provided in register with the closure strips.

7. A bag having two generally parallel sheets forming main walls of the bag, complementary closure strips fixed to respective ones of the sheets, and a cursor for actuating the strips for closing and opening purposes, the bag comprising, parallel to the closure strips, between said sheets, and level with a mouth of the bag, leakproofing structure in relief disposed on an inside of the closure strips, designed to provide sealing by forming a barrier between the sheets in a closed position of the bag, said leakproofing structure in relief being adapted to be urged towards a sealing position by the cursor when the cursor is moved towards a position for closing the bag, and in a vicinity of the mouth, thrust means situated on a side of the closure strips opposite from a side on which said leakproofing structure being situated for providing thrust between opposing inside faces of the walls of the bag, and urging means provided on the cursor for urging the walls of the bag inwards in a zone of said walls lying between the leakproofing structure and the thrust means, the urging means comprise beads on the walls of the bag.

8. A reclosable fastener comprising base webs with interlocking elements integrally attached thereto, said elements being opened and closed by a cursor mounted thereon and comprising integrally attached leakproof structure in relief provided on a first side of said interlocking elements, wherein said reclosable fastener further comprises thrust means provided on the second side of the complementary closure strips for coming into contact with each other when said elements are interlocked and the cursor being provided with urging means for urging said base webs in a zone between the leakproof structure and said thrust means, the base webs further comprising additional beads faced in register with the leakproof structure and in register with flanks of the cursor to guarantee that the leakproof structure is urged into a leakproof position when said elements are interlocked.

9. A reclosable fastener comprising base webs with interlocking elements integrally attached thereto, said elements being opened and closed by a cursor mounted thereon and comprising integrally attached leakproof structure in relief provided on a first side of said interlocking elements, wherein said reclosable fastener further comprises thrust means provided on the second side of the interlocking elements for coming into contact with each other when said elements are interlocked, the cursor being provided with urging means for urging said base webs in a zone between the leakproof structure and said thrust means, and the base webs being provided with grooves opening out to an outside surface of the base webs, respectively in register with the leakproof structure and ribs projecting from inside surfaces of flanks of the cursor, which ribs are adapted to penetrate respectively into said grooves.

10. A reclosable fastener comprising base webs with interlocking elements integrally attached thereto, said elements being opened and closed by a cursor mounted thereon and comprising integrally attached leakproof structure in relief provided on a first side of said interlocking elements, said leakproof structure comprising two leakproofing elements designed to bear against each other via tips, wherein said reclosable fastener further comprises thrust means provided on the second side of the complementary closure strips for coming into contact with each other when said interlocking elements are interlocked, and the cursor being provided with urging means for urging said base webs in a zone between the leakproof structure and said thrust means.

11. A reclosable fastener comprising base webs with interlocking elements integrally attached thereto, said elements being opened and closed by a cursor mounted thereon and comprising integrally attached leakproof structure in relief provided on a first side of said interlocking elements, said reclosable fastener further comprising thrust means provided on the second side of the complementary closure strips for coming into contact with each other when said elements are interlocked, the cursor being provided with urging means for urging said base webs in a zone between the leakproof structure and said thrust means, and the cursor being provided on an end of at least one of its side flanges with a rim directed towards an inside of the fastener and being also provided at the end of said rim with an additional flange directed toward a web of the cursor.

12. A reclosable fastener comprising base webs with interlocking elements integrally attached thereto, said elements being opened and closed by a cursor mounted thereon and comprising integrally attached leakproof structure in relief provided on a first side of said interlocking elements, said reclosable fastener further comprises thrust means provided on the second side of the complementary closure strips for coming into contact with each other when said elements are interlocked and the cursor being provided with urging means for urging said base webs in a zone between the leakproof structure and said thrust means, said urging means comprising beads on said base webs.

13. A reclosable fastener comprising base webs with interlocking elements integrally attached thereto, said elements being opened and closed by a cursor mounted thereon and comprising integrally attached leakproof structure in relief provided on a first side of said interlocking elements, said leakproof structure comprising elements designed to be juxtaposed and to bear against one another via facing adjacent flanks that are generally perpendicular to the base webs, said reclosable fastener further comprises thrust means provided on the second side of the complementary closure strips for coming into contact with each other when said elements are interlocked and the cursor being provided with urging means for urging said base webs in a zone between the leakproof structure and said thrust means.

14. A film for making a bag, comprising complementary closure strips actuatable by a cursor together with sealing means in relief disposed on insides of the closure strips for sealing by forming a barrier between sheets that are to form the bag, when the bag is in a closed position, thrust means situated opposite said sealing means relative to the closure strips for causing opposite inside faces of the bag walls to bear against one another, the sealing means in relief providing sealing being constituted by elements designed to be juxtaposed and to bear against one another via facing adjacent flanks that are generally perpendicular to the sheets.

15. A tape adapted to be attached to two sheets for making a bag, comprising sealing means in relief disposed on an inside of closure strips for sealing by forming a barrier between the two sheets, when the bag is in a closed position, thrust means situated opposite said sealing means relative to the closure strips for causing opposite inside faces of the sheets of the bag to bear against each other, the sealing means in relief providing sealing being made up of elements designed to be juxtaposed and to bear against one another via facing adjacent flanks that are generally perpendicular to the sheets.

* * * * *

UNITED STATES PATENT AND TRADEMARK OFFICE
Certificate

Patent No. 6,733,178 B2 Patented: May 11, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Henri Bois, Neuilly sur Seine (FR); and Steven Ausnit, New York, NY (US).

Signed and Sealed this Third Day of April 2007.

NATHAN J. NEWHOUSE
*Supervisory Patent Examiner*
Art Unit 3782